US005257897A

United States Patent [19]

Yamamoto et al.

[11] Patent Number: 5,257,897

[45] Date of Patent: Nov. 2, 1993

[54] CAN CONVEYING SYSTEM

[75] Inventors: Yoshio Yamamoto; Keizo Ohori, both of Kyoto; Tsuneo Shimizu, Anjo, all of Japan

[73] Assignee: Murata Kikai Kabushiki Kaisha, Kyoto, Japan

[21] Appl. No.: 866,891

[22] Filed: Apr. 1, 1992

Related U.S. Application Data

[62] Division of Ser. No. 710,504, Jun. 4, 1991, Pat. No. 5,222,856.

[30] Foreign Application Priority Data

Jun. 5, 1990 [JP] Japan ..... 2-147587
Jul. 18, 1990 [JP] Japan ..... 2-187893

[51] Int. Cl.[5] ..... B65G 65/02

[52] U.S. Cl. ..... 414/609; 57/281; 104/93

[58] Field of Search ..... 414/352, 353, 512, 513, 414/609, 560, 659, 661, 280, 281, 401, 222; 57/90, 281; 19/159 A; 104/93, 122; 198/468.6

[56] References Cited

U.S. PATENT DOCUMENTS

| | | | |
|---|---|---|---|
| 2,811,240 | 10/1957 | Fenton | 414/661 X |
| 3,124,257 | 3/1964 | Price et al. | 414/222 |
| 3,518,945 | 7/1970 | Raney et al. | 104/93 X |
| 3,630,319 | 12/1971 | Peterson et al. | 414/661 X |
| 3,672,306 | 6/1972 | Dehne et al. | 104/93 X |
| 3,901,180 | 8/1975 | Allen et al. | 198/468.6 X |
| 4,023,339 | 5/1977 | Laderach et al. | 57/281 X |
| 4,280,411 | 7/1981 | Katayose | 104/93 X |
| 4,423,808 | 1/1984 | Venturelli | 198/468.6 X |
| 4,841,719 | 6/1989 | Sasaki et al. | 57/281 |
| 4,924,999 | 5/1990 | Kikuchi et al. | 198/468.6 X |
| 4,925,000 | 5/1990 | Pacakova et al. | 57/90 X |
| 5,007,522 | 4/1991 | Focke et al. | 414/609 X |
| 5,064,331 | 11/1991 | Yamaguchi et al. | 414/609 X |
| 5,085,553 | 2/1992 | Bouwens et al. | 414/661 X |
| 5,099,641 | 3/1992 | Igel et al. | 57/281 |
| 5,100,516 | 3/1992 | Nishimura et al. | 414/222 X |
| 5,147,177 | 9/1992 | Kikuchi et al. | 198/468.6 |

FOREIGN PATENT DOCUMENTS

| | | | |
|---|---|---|---|
| 1188026 | 3/1965 | Fed. Rep. of Germany | 414/560 |
| 3634683 | 4/1988 | Fed. Rep. of Germany | 57/281 |
| 2610609 | 8/1988 | France | 414/281 |
| 133801 | 5/1989 | Japan | 414/281 |
| 287581 | 1/1971 | U.S.S.R. | 414/821 |

*Primary Examiner*—David A. Bucci
*Attorney, Agent, or Firm*—Spensley Horn Jubas & Lubitz

[57] ABSTRACT

A sliver can conveying system comprising carriages having vertically movably suspended cages, and adapted for traveling overhead in a spinning factory along a path provided between stations of the factory, each of the carriages being capable of holding cans in the cages, and movable between the positions where they are loaded and unloaded with full cans, and the positions where they are loaded and unloaded with empty cans, thereby enabling the exchange of the full and empty cans.

2 Claims, 20 Drawing Sheets

CAN CONVEYING SYSTEM

This is a division of application Ser. No. 07/710,504, filed on Jun. 4, 1991, now U.S. Pat. No. 5,222,856.

FIELD OF THE INVENTION

This invention relates to a system for conveying cans in a spinning factory and particularly relates to a system for conveying cans which are used to hold slivers when the slivers are supplied.

RELATED ART STATEMENT

A series of steps including mixing and blowing, carding, preparation for combing, combing, first drawing, second drawing, roving, fine spinning, and rewinding, are generally employed for making yarn from raw cotton in a spinning factory.

Cans are used for conveying slivers from the carding station to the roving station. FIGS. 18*a–c* shows conventionally known can conveying systems: FIG. 18*a* is one including roller conveyors 201, driven or not driven, on which cans 1 are conveyed (conveyance by roller conveyors), FIG. 18*b* is one including belt conveyors 202 on which cans 1 are conveyed (conveyance by belt conveyors), and FIG. 18*c* is one including a can engaging hook 203 which is engageable with the back of a can at its bottom to convey it (conveyance by chain conveyor). There is also known a system including a robot 204 having arms 205 which hold a can 1 leaving a comber 2*a*, and rotated by 180° to place the can on a conveyor belt 206, as shown in FIG. 19.

All of the known can conveying systems are, however, designed for conveying cans in an area close to the ground, and are, therefore, obstacles to the operators who walk on the ground. An exclusive floor space is required for the installation of the conveying apparatus, and adds to the floor area of the spinning factory as a whole. In the event that any such can conveying equipment is newly installed in an existing factory, the availability of only a narrow space between the spinning machines, the presence of building columns, or other obstacles, etc. make it impossible to prepare a path for the conveyance of cans along the shortest route.

OBJECT AND SUMMARY OF THE INVENTION

In view of the problems as hereinabove pointed out, it is an object of this invention to provide a can conveying system which does not require any floor space, but enables a path for the conveyance of cans to be taken as desired, and along the shortest route.

The can conveying system of this invention comprises carriages having vertically movably suspended cages, and adapted for traveling overhead in a spinning factory along a path provided between stations of the factory, each of the carriages being capable of holding cans in the cages, and movable between the positions where they are loaded and unloaded with full cans, and the positions where they are loaded and unloaded with empty cans, thereby enabling the exchange of the full and empty cans.

As sliver cans are suspended by the cages of the carriages when they are conveyed in the factory, the system does not require any such floor space as is required exclusively for any machine of the type conveying cans in the area close to the ground, and does not form any obstacle to the operators who walk on the floor. This advantage is particularly worthy of mention if the path along which the carriages travel lies in parallel to any passage that is available on the floor between the machines or frames, or between the stations. Moreover, the system can convey the slivers without causing any compression thereof by vibration resulting in the lack of uniformity in thickness.

DETAILED DESCRIPTION OF PREFERRED EMBODIMENT

Figure 1A:
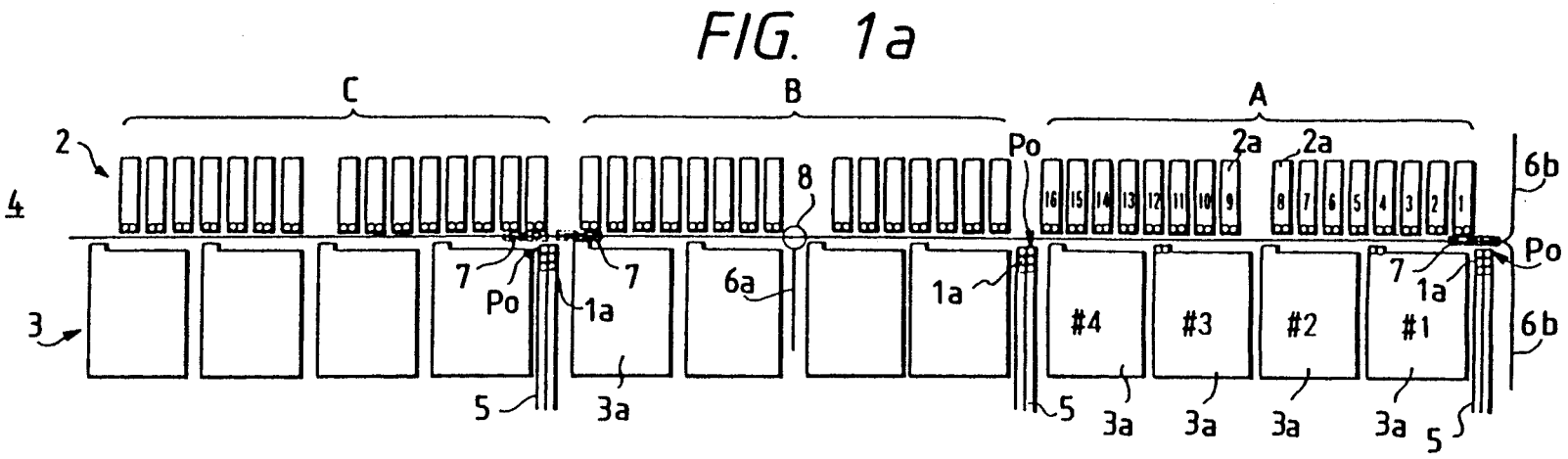
FIGS. 1*a* and *b* is a top plan view of the system according to one embodiment of this invention.

The invention will now be described with reference to its embodiments shown in the drawings.

(1) Embodiment 1

Figure 1B:
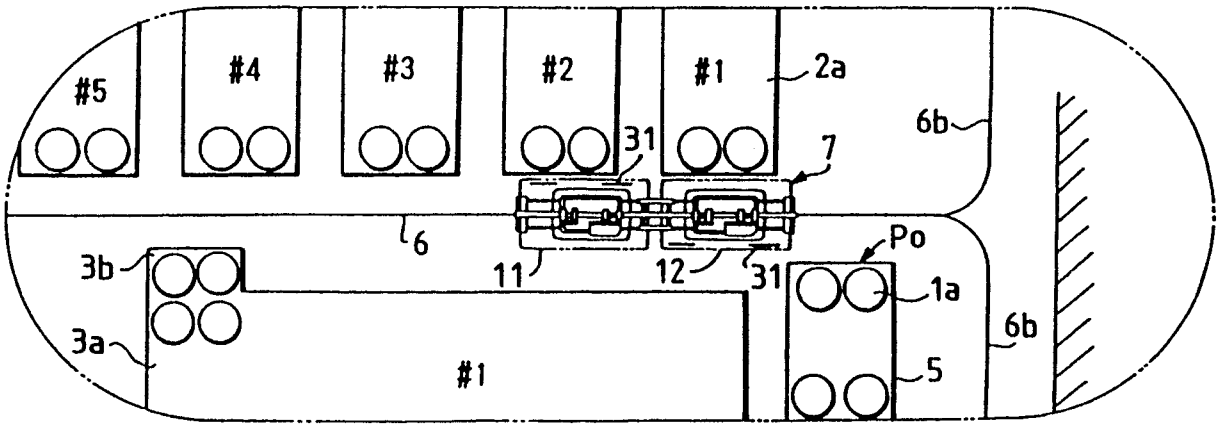

FIGS. 1*a* and *b* shows a system embodying this invention and used for conveying cans from a combing step or station to a drawing step or station. FIG. 1*a* shows the whole of the combing station 2 and of the drawing station 3 carrying out the step following the combing between which cylindrical cans 1 each having a closed bottom are conveyed, and FIG. 1*b* is an enlarged view of the right-most portion thereof.

As shown, a plurality of combers 2*a* are arrayed on the ground in an equally spaced apart relation from one another, and a plurality of drawing frames 3*a* installed on the floor 4 in the same plane with the combers form an array facing the array of the combers in an appropriately spaced apart relation from it. Empty can conveyors 5 for conveying empty cans 1*a* are installed alongside the drawing station 3.

A rail 6 lies overhead along a passage formed on the floor between the stations 2 and 3, and three carriages 7 for conveying the cans 1 are vertically movably suspended from the rail 6. The rail 6 is connected at the middle point of its length to a standby line 6*a* by a turntable 8 positioned therebetween, and has its right end connected to repairing lines 6*b*.

Figure 2:
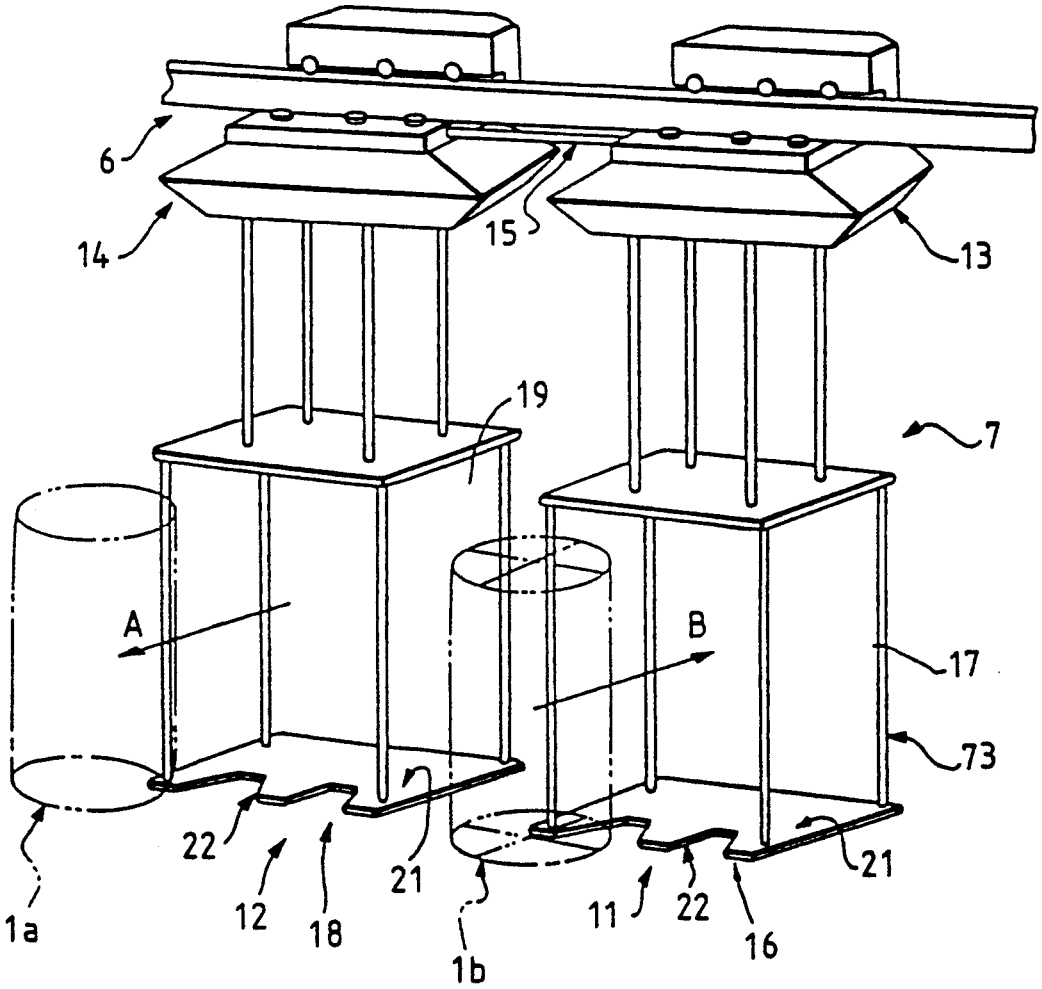
FIG. 2 is a perspective view of a carriage.

(a) Carriages:

Each carriage 6 suspended from the rail 7 comprises a full-can cage 11 for conveying full cans 1*b* containing slivers, and an empty-can cage 12 for conveying empty cans 1*a* not containing slivers, as shown in FIG. 2. This pair of cages 11 and 12 are suspended by ropes, etc. vertically movably independently of each other from drive units 13 and 14, respectively, which are connected to the rail 6 and are also connected to each other by a connecting member 15 extending along the rail 6 so as to form a unitary assembly. Therefore, the cages 11 and 12 travel together, while they are vertically movable independently of each other. Each of the cages 11 and 12 under description is so designed as to contain two cages. Although each carriage 7 as hereinabove described is a unitary assembly formed by the connecting member, it is alternatively possible to employ a pair of carriages which are not connected to each other.

Both of the cages 11 and 12 are approximately rectangular, as shown in FIG. 2, and the full-can cage 11 has an inlet and an outlet 17 for full cans 1*b* which are respectively formed on two opposite sides facing the two stations 2 and 3, respectively. The inlet 16 of the full-can cage 11 faces the combing station 2, while the outlet 17 faces the drawing station 3. On the other hand, the empty-can cage 12 has an outlet 18 facing the combing station 2, and an inlet 19 facing the drawing station 3. It follows that the inlet 16 and outlet 17 of the full-can cage 11 and the inlet 19 and outlet 18 of the empty-can cage 12 are so positioned that the cans are moved in the opposite directions A and B when they are received in, and delivered from, the cages 12 and 11.

The cages 11 and 12 are otherwise of the same construction. Therefore, the following description is limited to the empty-can cage 12, and no description of the full-can cage 11 will be made.

Figure 3:
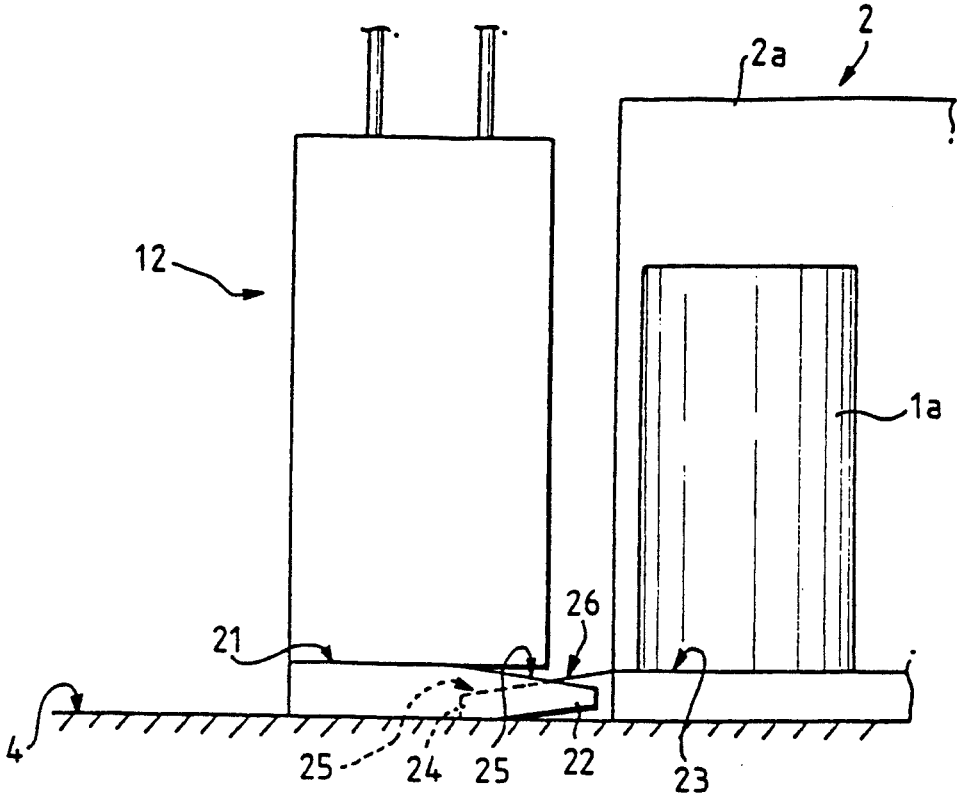
FIG. 3 is a side elevational view, partly in section, showing the carriage lowered on the floor.
Figure 4:
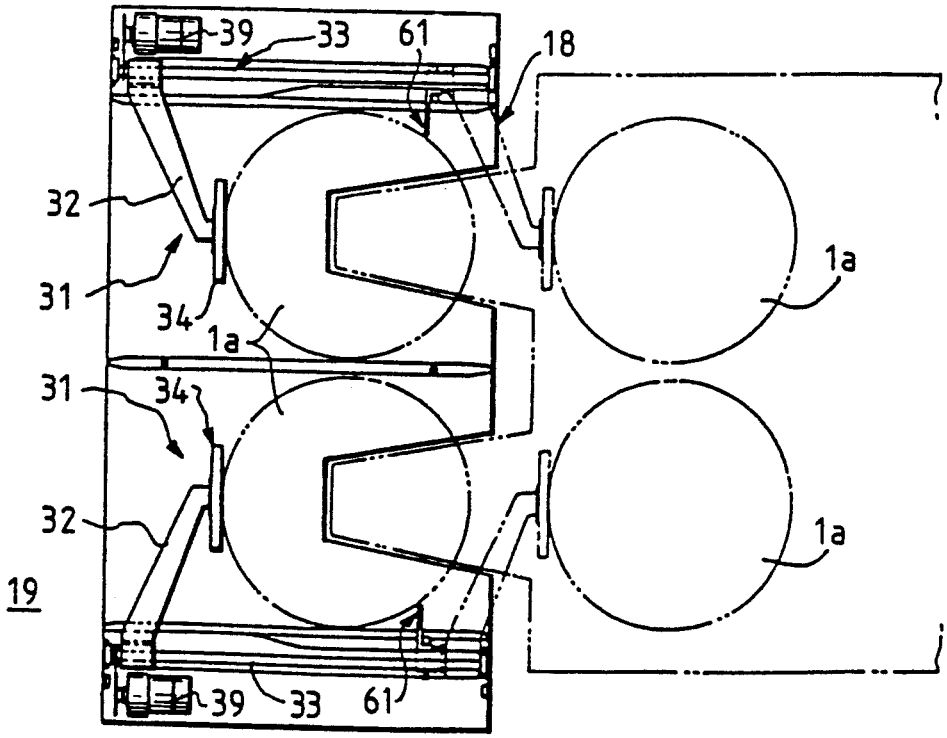
FIG. 4 is a top plan view of a cage.

The empty-can cage 12 has at its bottom a flat mounting portion 21 on which empty cans 1*a* are mounted, as shown in FIGS. 2 and 3. That side of the mounting portion 21 which faces the combing station 2 has a plurality of trapezoidal engaging pawls 22, and each comber in the combing station 2 has a bottom plate 23 formed with similar engaging pawls 24. The engaging pawls 22 and 24 are formed in a staggered relation so as to engage each other upon lowering of the cage 12 to its position in front of the combing station 2, and terminate each in a tapered end portion 25 having a surface inclined downwardly toward the floor 4, as shown in FIGS. 3 and 4. The engagement of the engaging pawls 22 and 24 forms an obtusely V-shaped groove 26 which makes only so small a difference in height from the surfaces of the mounting portion 21 and the bottom plate 23 as not to present any problem in the transfer of cans.

A pair of pushers 31 are provided for pushing out empty cans 1*a* toward the combing station 2 through the outlet 18 of the cage 12 which has been lowered on the floor, as shown in FIG. 4. The pushers 31 are installed on the mounting portion 21 so that a pair of empty cans 1*a* to be transferred may be located between the pushers 31. Each pusher 31 consists mainly of an arm 32 engaging an empty can 1*a*, and a guide rod 33 for guiding the movement of the arm 32 in the direction for pushing out the can.

Figure 5:
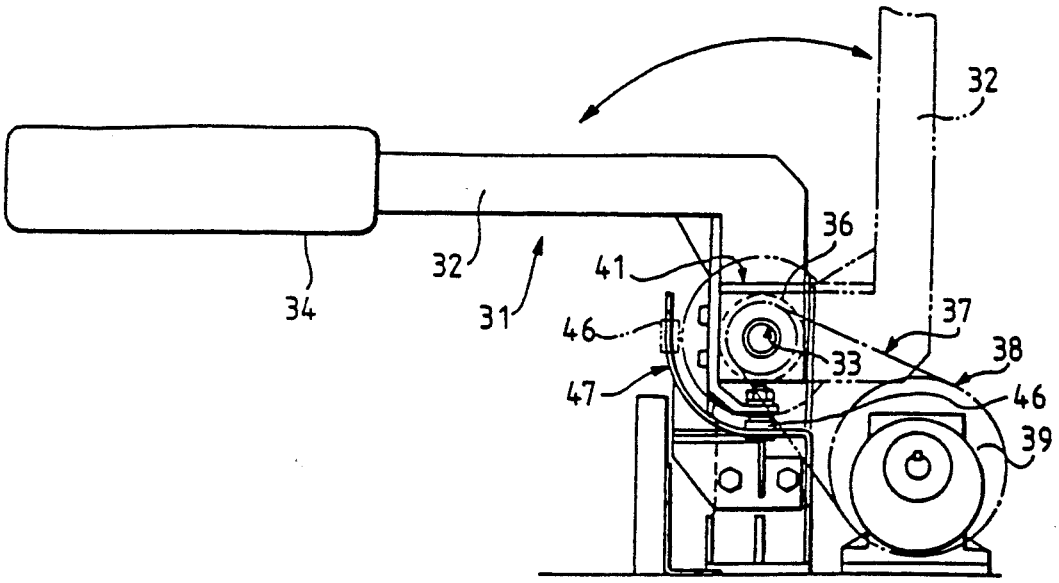
FIGS. 5 to 10 are each a view showing a part of the carriage.
Figure 6:
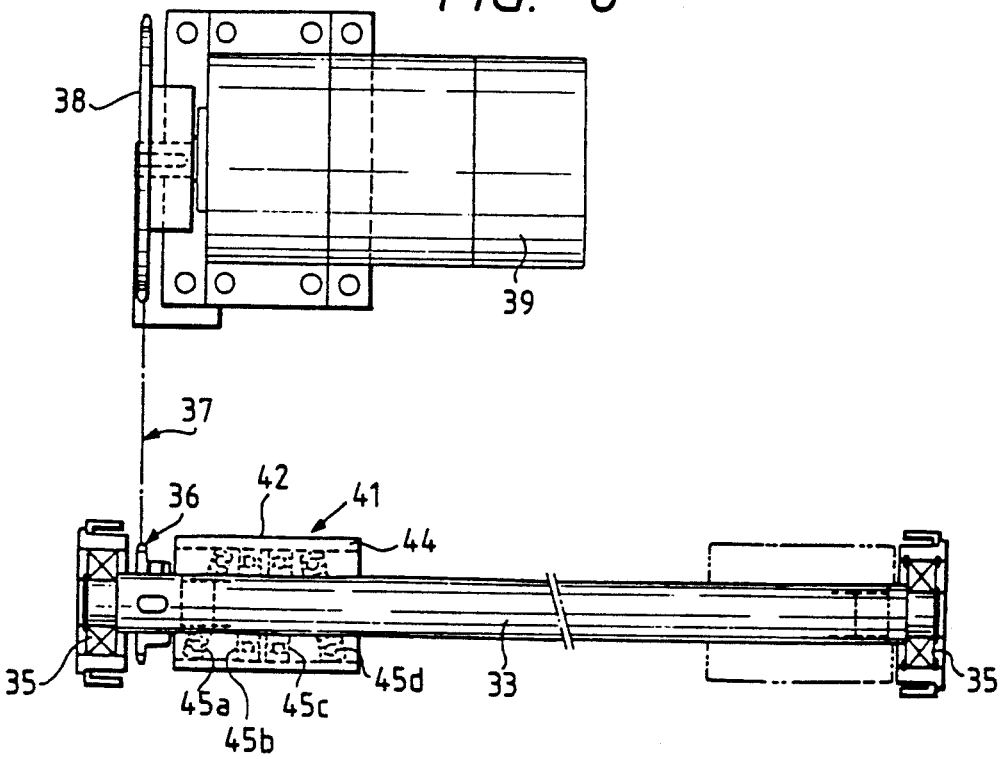

The arm 32 is approximately L-shaped, and has a free end provided with a pad 34 engaging the back of the empty can 1*a* as viewed in the direction in which it is pushed out, as shown in FIGS. 4 and 5. The guide rod 33 extends in parallel to the direction in which the empty can 1*a* is pushed out, and is supported by bearings 35 at both ends, as shown in FIGS. 5 and 6, while a drive motor 39 is connected to one end of the rod 33 through a driven sprocket 36, a chain 37 and a driving sprocket 38 for rotating the guide rod 33 in either direction.

A slider 41 forming the base end of the arm 32 is reciprocatively provided on the guide rod 33. The slider 41 comprises a feed mechanism 42 for reciprocating the arm 32 along the guide rod 33, as shown in FIG. 6, and a cam mechanism 43 for guiding the movement of the arm 32 as shown in FIG. 7.

The feed mechanism 42 comprises a linear drive nut 44 surrounding the guide rod 33, and four ball bearings 45*a* to 45*d* fitted between the drive nut 44 and the guide rod 33 at an angle to the longitudinal axis of the guide rod 33. The feed mechanism 42 enables the reciprocating movement of the arm 32 as a result of the rotation of the guide rod 33 in either direction, and also the axial movement of the arm 32 relative to the guide rod 33.

Figure 7:
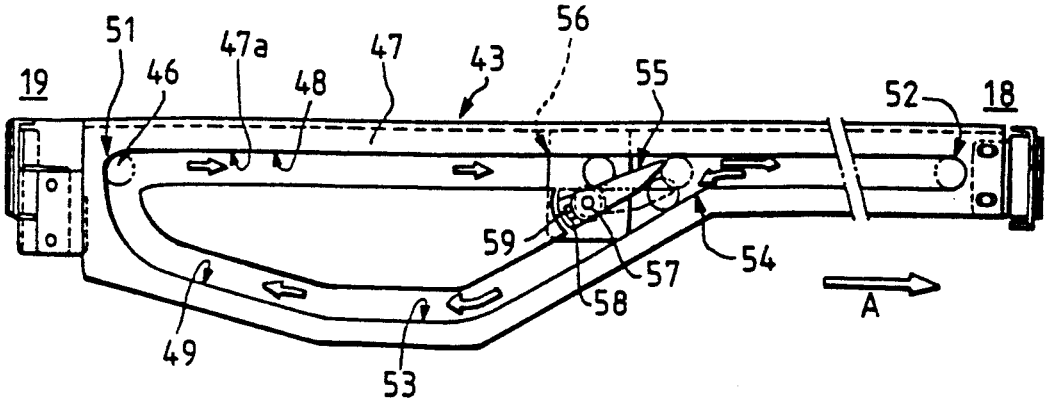

For guiding the movement of the arm 32, the cam mechanism 43 includes a cam follower 46 provided on the slider 41, as shown in FIGS. 5 and 7. The cam follower 46 engages a closed-loop guide groove 47*a* in a guide plate 47 supported along the guide rod 33, as shown in FIG. 5. The guide groove 47*a* comprises a straight groove 48, and a curved groove 49 diverging from the straight groove 48 and meeting it again at one end thereof.

When the cam follower 46 moves along the straight groove 48 from one end 51 thereof near the inlet 19 to the other end 52 thereof near the outlet 18, the arm 32 is guided for movement in the direction A for pushing out the empty can la, while it is held in its horizontally lowered position. When, on the other hand, the cam follower 46 moves along the curved groove 49, the arm 32 is raised, and when the cam follower 46 has arrived at a standby position 53 approximately in the middle of the curved groove 49, the arm 32 is brought to its upright position with the pad 34 up, as shown by a chain line in FIG. 5. Thus, the movement of the cam follower 46 from the standby position 53 to one end 51 of the straight groove 48 near the inlet of the cage along the curved groove, from there to the other end 52 of the straight groove near the outlet of the cage, and from there back to the standby position 53 along the straight and curved grooves past a diverging point 54, gives rise to one cycle of arm movement in which the arm 32 moves in the direction A for pushing out the empty can 1*a*, and returns to its upright position.

Figure 8:
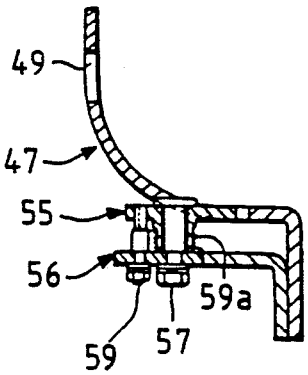

The diverging point 54 is provided with a lever 55 which is rotatably supported by a shaft 57 on a supporting plate 56. The lever 55 has at its base end an arcuate slot 58 through which a pin 59 extends, as shown in FIG. 8. A coil spring 59*a* is provided for urging the lever 55 so that the distal end of the lever may normally be kept in its position in which the curved groove 49 remains open. The cam follower 46 can overcome the urging force of the coil spring 59*a* and move past the lever during its movement from one end 51 of the straight groove 48 to the other end 52 thereof.

The empty-can cage 12 is also provided near its outlet 18 with a pair of transversely spaced apart rotatable stoppers 61 for positioning the empty cans 1*a* which have been received through its inlet 19, as shown in FIG. 4.

Figure 9:
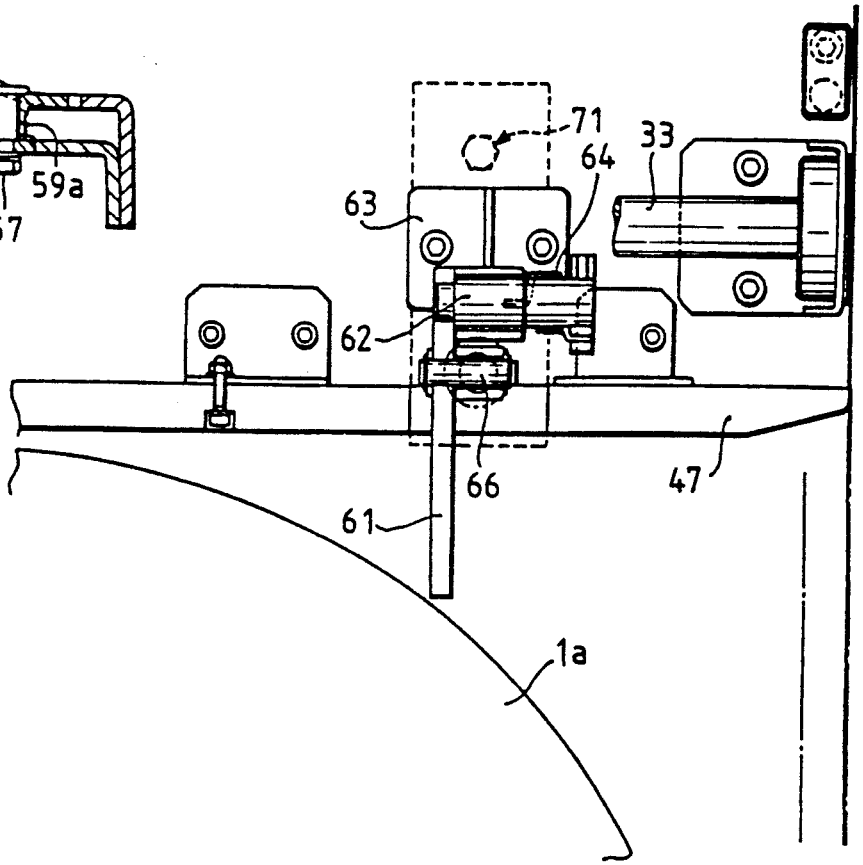
Figure 10:
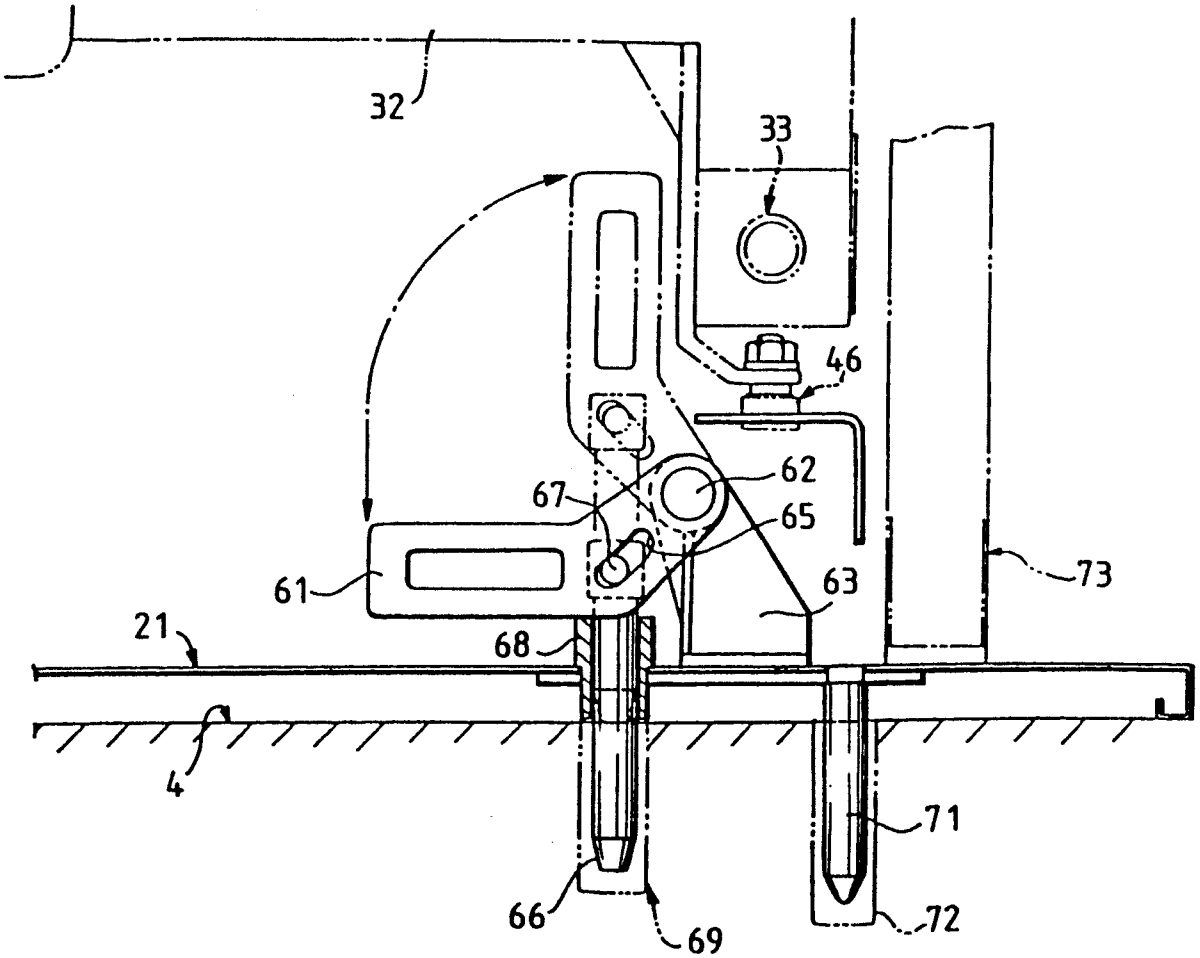

Each stopper 61 has at its base end a shaft 62 which is rotatably supported on a bracket 63 below, and which is provided with a coil spring 64 urging the stopper 61 to its lowered position, as shown in FIGS. 9 and 10. The stopper 61 has a dogleg shape, and has approximately in the middle thereof a slot 65 into which a pin 67 extends from one end of a stopper pin 66, as shown in FIG. 10. The stopper pin 66 has a distal end which can be fitted in a sleeve 68 extending through the mounting portion 21, and is vertically movable through the sleeve 68 to a point below the mounting portion 21. The floor 4 has a hole 69 which is so positioned as to be alignable with the stopper pin 66 when the empty-can cage 12 is lowered on the floor. The hole 69 is provided for receiving the stopper pin 66 and thereby allowing the rotation of the stopper 61 to its horizontal, or closed position when the cage 12 has been lowered on the floor.

If the stopper pin 66 contacts the floor 4 around the hole 69, it is pushed up and thereby rotates the stopper 61 to its raised position. Thus, the hole 69 governs the opening and closing of the stopper 61. The system under description is so constructed that, when the cage 12 has been lowered on the floor to receive empty cans 1*a*, the stoppers 61 are rotated to their horizontal, or closed positions for positioning the cans 1*a* which have been received in the cage 12.

Positioning pins 71 depend from the mounting portion 21, and holes 72 are formed in the floor 4 for receiving the positioning pins 71 therein to position the empty-can cage 12 when it is lowered on the floor.

The full-can cage 11 is provided with pushers 31 and stoppers 61 which are of the same construction as those which have hereinabove been described. 73 is a framework.

(b) Conveyance of cans between the combing and drawing stations:

Description will now be made of the operation of the carriages in the can conveying system between the combing and drawing stations.

Referring again to FIGS. 1*a* and *b*, the cans 1 are transferred by the carriages 7 between the combing and drawing stations 2 and 3 facing each other. The machines in the combing station 2 and the drawing station 3 are divided in three groups A, B and C, and one empty-can conveyor 5 is provided for each group. Each carriage 7 is provided for one of groups A, B and C.

As all of the carriages 7 for Groups A, B and C work in the same way, the following description is limited to the operation of the carriage for Group A.

The carriage 7 first stays above the delivery end $P_0$ of the empty-can conveyor 5 provided alongside the drawing station 3. The end $P_0$ defines a point of origin for the movement of the carriage. At the point of origin $P_0$, the empty-can cage 12 of the carriage 7 receives two empty cans 1*a* from the empty-can conveyor 5, while the full-can cage 11 does not contain any full can 1*b*.

Figure 11:
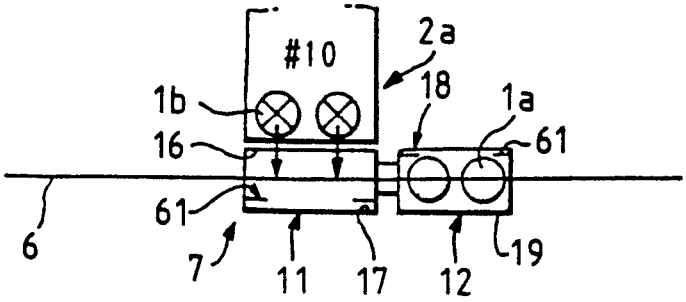
FIGS. 11 to 13 are each a top plan view of a first embodiment of the cage in which cans are being received, or from which cans are being delivered.

The carriage 7 travels to one of the combers 2*a* in Group A which has outputted a preliminary full-can signal, e.g. comber #10, as shown in FIG. 11. The carriage 7 is stopped so as to have its full-can cage 11 positioned above comber #10, and the cage 11 is lowered on the floor. As soon as the comber 2*a* has outputted a full-can signal, its operation is stopped, and two full cans 1*b* are forced out of the comber 2*a* into the full-can cage 11. When the full-can cage 11 has been lowered on the floor, the engaging pawls 22 which its mounting portion 21 has along one side thereof, and the engaging pawls 24 which the comber 2*a* has, engage each other in a staggered pattern and form the groove 26 therebetween, as shown in FIG. 3. The engagement of the pawls makes it possible to eliminate substantially any difference in height between the mounting portion 21 of the cage 11 and the delivery end of the comber 2*a*, and thereby accomplish the smooth delivery of the full cans 1*b* from the comber 2*a*. The full cans 1*b* which have been received in the cage 11 are held in position by the stoppers 61 near the outlet 17 so as not to fall off the cage 11.

The full-can cage 11 which has received two full cans 1*b* from comber #10 is raised, and the carriage 7 is moved by a distance equal to the pitch between the full-can cage 11 and the empty-can cage 12, so that the empty-can cage 12 may replace the full-can cage 11 in front of comber #10. The empty-can cage 12 is lowered on the floor, and the two empty cans 1*a* are pushed out simultaneously by the pushers 31. Should any abnormal load bear on the pushers 31, the ball bearings 45*a* to 45*d*, which are shown in FIG. 6, slide axially on the guide rod 33 to absorb the load and thereby ensure safety. The empty-can cage 12 is raised after it has delivered the empty cans 1*a* to comber #10.

Thus, the carriage has finished receiving the full cans 1*b* from comber #10 and delivering the empty cans 1*a* to it. As a result, the full cans 1*b* which have been delivered from the combing station 2 are replaced by the empty cans 1*a* from the empty-can cage 12. The comber 2*a* which has received the empty can 1*a* is placed in operation again.

Then, the carriage 7 for Group A travels to any of the drawing frames 3*a* in Group A that has made a demand for full cans, e.g. #4.

Figure 12:
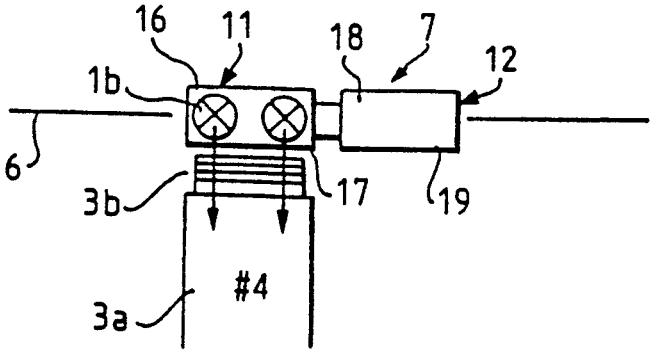

After the carriage 7 has been moved to drawing frame #4 as shown in FIG. 12, the full-can cage 11 containing two full cans 1*b* is lowered on the floor. As soon as it is lowered on the floor, the stoppers 61 are retracted. The full cans 1*b* are delivered by the pushers 31 from the cage 11 to a conveyor 3*b*. The full cans 1*b* are received in the drawing frame 3*a*, while the full-can cage 11, which is now empty, is raised, and is returned with the empty-can cage 12 to the point of origin $P_0$ at the empty-can conveyor 5.

Figure 13:
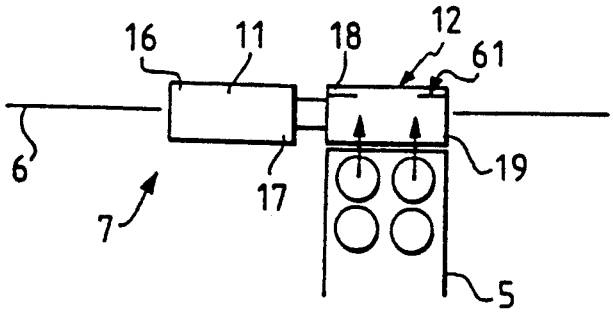

Referring now to FIG. 13, the empty-can cage 12 is lowered at the point of origin $P_0$, and two empty cans 1*a* are delivered from the empty-can conveyor 5 into the cage 12 having the pushers 31 kept in their retracted positions, and held in position by the stoppers 61. Then, the cage 12 is raised and waits until a preliminary full-can signal is outputted from any comber 2*a*. When such a signal has been received, the aforementioned procedures are repeated for the exchange of the empty cans 1a and the full cans 1b. Thus, the empty cans 1a from the empty-can conveyor 5 are exchanged with two full cans 1b containing the slivers produced in the combing station 2, the full cans 1b are transferred to the drawing station 3, and another two empty cans 1a are received from the conveyor 5.

Thus, the cans 1 can be conveyed overhead by the cages 11 and 12 of the carriage 7 which are vertically movably suspended from the rail 6 lying overhead in parallel to the passage for general use between the machines, or stations. When they are conveyed, it is possible to avoid any interference, whether horizontally or vertically. It is possible to employ not only a single rail, but also a pair of rails. Each cage can receive or deliver the cans on all of four sides. The carriage may comprise a single cage, a pair of cages connected to each other, or a pair of independent cages, or any combination thereof.

(2) Embodiment 2

The foregoing description has been of the system embodying this invention for carrying out the exchange of the cans 1 between the combing and drawing stations. The exchange of cans 1 by cages 11 and 12 can, however, be accomplished also between the carding station and the station of preparation for combing, between the combing and drawing stations, or between the drawing and roving stations, as shown in FIG. 14.

Figure 14:
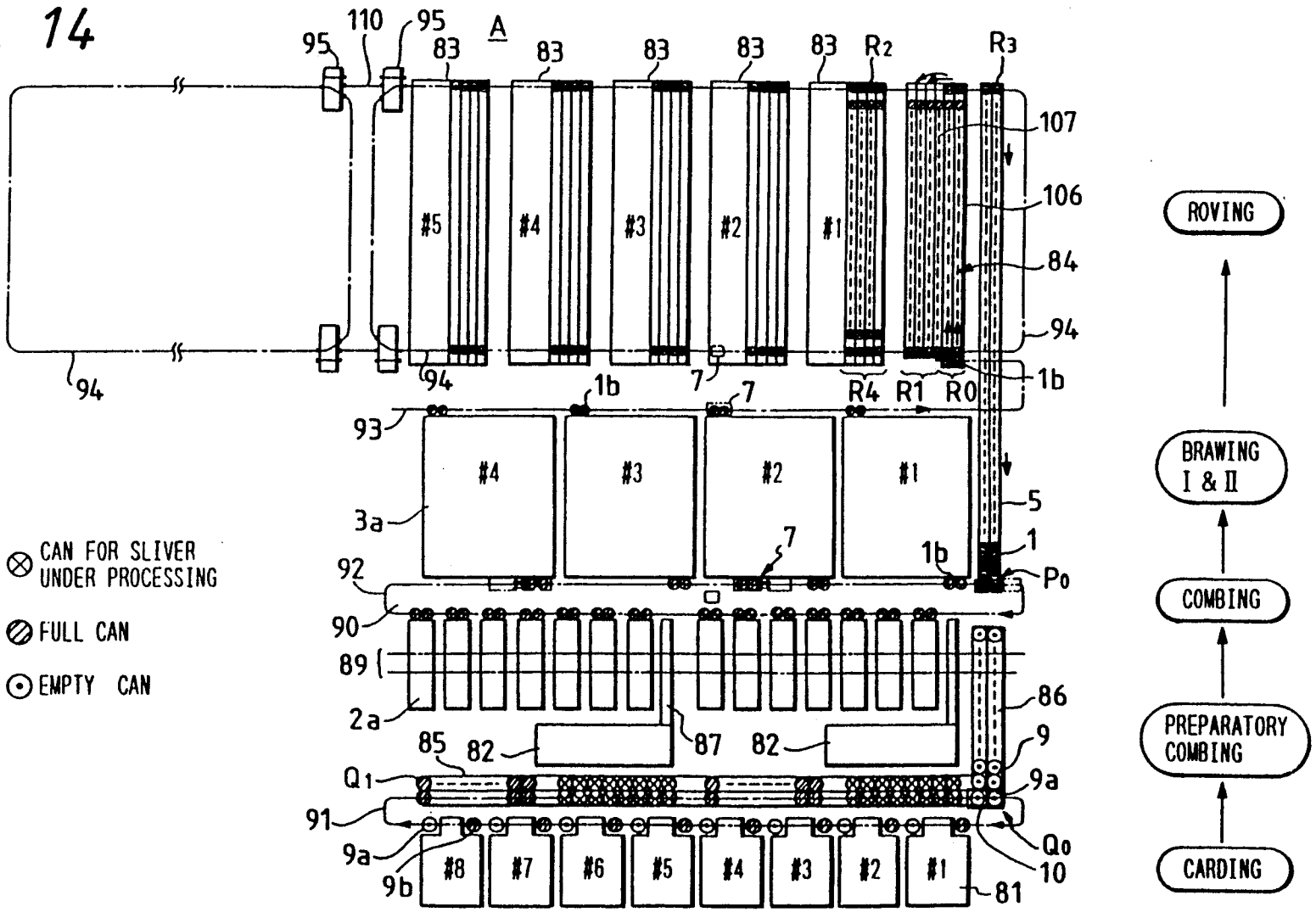
FIG. 14 is a top plan view showing the system according to another embodiment of this invention.

(a) Construction of system:

FIG. 14 shows an arrangement composed of carding engines 81, preparatory combing machines 82 including a sliver lap machine and a ribbon lap machine, combers 2a, drawing frames 3a including ones for first and second drawing I and II, roving frames 83, and a stock room 84 for the roving frames. Although FIG. 14 shows only a group of eight carding engines 81, two preparatory combing machines 82, 14 combers 2a, four drawing frames 3a, five roving frames 83, and a single stock room 84, there also exists another group of each machine or frame occupying the left-hand side of FIG. 14, as suggested only with respect to the roving machines 83.

The array of the carding engines and the two preparatory combing machines 82 have therebetween a space in which a track 85 is provided on the ground along the array of the carding engines for conveying and storing full cans and cans under preparation. An empty-can conveyor 86 is provided on the ground for stocking empty cans 9a, is connected to the right end of the track 85 at right angles thereto, and extends to the combers 2a. Another empty-can conveyor 5 is provided on the ground and extends in alignment with the empty-can conveyor 86 and alongside the drawing and roving stations, as shown at the right end of FIG. 14. The cans 9 which are employed between the carding station and the preparatory combing station are greater in size than the cans 1 employed between the combing and drawing stations.

A track 91 formed as a closed loop of the rail 6 (FIG. 2) is provided overhead in the spinning factory above the space between the carding engines 81 and the preparatory combing machines 82 and extends along the array of the carding engines, and a carriage 10 is suspended from it. The carriage 10 has a full-can cage 11 and an empty-can cage 12, as any of the carriages 7 as hereinabove described does. The carriage 10 is basically of the same construction with the carriage 7, except that the former can hold only one can 9 in each of the full-can and empty-can cages 11 and 12 for conveyance in an unattended way, since the cans 9 are large.

A track 92 for the carriages 7 as employed in the system of FIG. 1 is provided between the combing and drawing stations. The track 92 is, however, in the form of a closed loop and differs from the rail employed in the system of FIG. 1. A track 93 for a carriage 7 is provided between the drawing and roving stations. The track 93 is not in the form of a closed loop, but extends straightly along the array of the drawing frames from the last frame to the first and is so curved as to reach the inlet of the stock room 84 in the roving station. A track 94 in the form of a closed loop is provided for a carriage 7 in the roving station. The track 94 surrounds the five roving frames 83 and the stock room 84 which form a group of machines defining one unit of the roving station. Therefore, there are a plurality of tracks 94 of which each, as well as an empty-can conveyor 5, surrounds one of a plurality of units of the roving station. The tracks 94 for two adjoining units can be connected to each other by switch tables 95, so that if all of the tracks 94 are connected to one another, they can form a closed loop extending around the whole of the roving station.

(b) Conveyance of cans between the carding and preparatory combing stations

The carriage 10 starts traveling at a point of origin where the empty-can conveyor 86 meets the track 91 as viewed in FIG. 14. The carriage 10 waits at the point of origin $Q_0$ where its empty-can cage 12 receives an empty can 9a from the empty-can conveyor 86. Then, the carriage 10 travels to any of the carding engines 81 that has outputted a full-can signal, e.g. #8. It is stopped so that its full-can cage 11 may be situated above the position where a full can is to be picked up (as shown by a circle containing slanting lines), and the cage 11 is lowered. After the cage 11 has been lowered on the floor, a full can 9b containing a full bobbin is forced out of carding engine #8 into the cage 11. The smooth delivery of the full can 9b is accomplished by virtue of the staggered engagement between the inclined engaging pawls 22 of the mounting portion 21 and the inclined engaging pawls 24 of the carding engine 81 as hereinbefore described with reference to FIG. 3. The stoppers 61 prevent the full can 9b from falling off the cage 11.

The cage 11 which has received the full can 9b from carding engine #8 is raised, and the carriage 10 is slightly moved, so that the empty-can cage 12 may be situated in front of the position where the empty can is to be lowered for delivery to carding engine #8 (as shown by a simple circle). The cage 12 is lowered on the floor, and the pushers 31 are driven for pushing the empty can 9a out of the cage 12. Then, the cage 12 is raised.

Thus, the exchange of full and empty cans 9b and 9a is accomplished for each carding engine 81.

Then, the carriage 10 holding the full can 9b in the cage 11 travels to the preparatory combing station. It is stopped above the position $Q_1$ where the full can is to be lowered on the track 85, and the cage 11 is lowered on the track 85. The stoppers 61 are retracted, and the pushers 31 are driven for pushing the full can 9b out of the cage 11 onto the track 85. Then, the cage 11 is raised, and the cage 11 is returned to the point of origin $Q_0$ on the empty-can conveyor 86.

Figure 15:
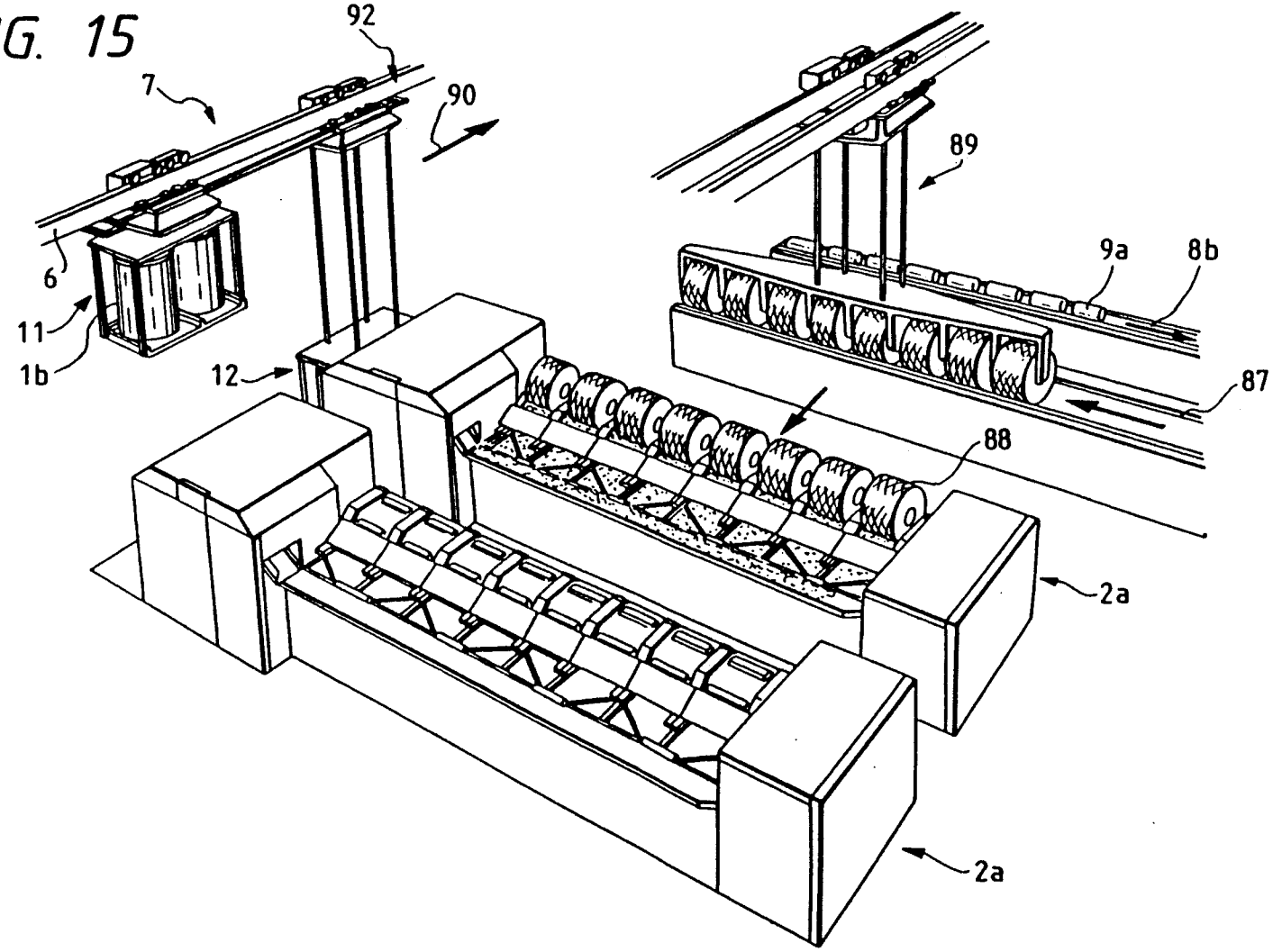
FIG. 15 is a perspective view of the preparatory combing station and the combing station.

Full cans 9b are, thus, received on the track 85 one after another, and a set of 16 cans 9b are fed to each preparatory combing machine 82, as shown each by a circle containing an 'x'. In each preparatory combing machine 82, the 16 slivers from the full cans 9b are doubled and drafted to about 1.4 to 1.5 times by the sliver lap machine to form a lap, and the lap is drafted to about 5.5 to 6.0 times by the ribbon lap machine to form a fleece. The fleeces are doubled to produce finish laps 88 on the conveyor 87, as shown in FIG. 15. A set of eight laps 88 are picked up from the conveyor 87 and conveyed overhead by a lap carrier 89 to feed each comber 2a.

Each comber 2a has eight heads each used for combing one of the laps 88, whereby the slivers are combined and drafted to form two combed slivers, and the combed slivers are supplied into two cans 1 through a coiler.

(c) Conveyance of cans between the combing and drawing stations:

The following is a description of the conveyance of cans along the track 92 which is substantially identical to its counterpart used in the system of FIG. 1.

Each carriage 7 normally stays above the end of the empty-can conveyor 5 (point of origin $P_0$) and holds two empty cans 1a in its empty-can cage 12.

Figure 16:
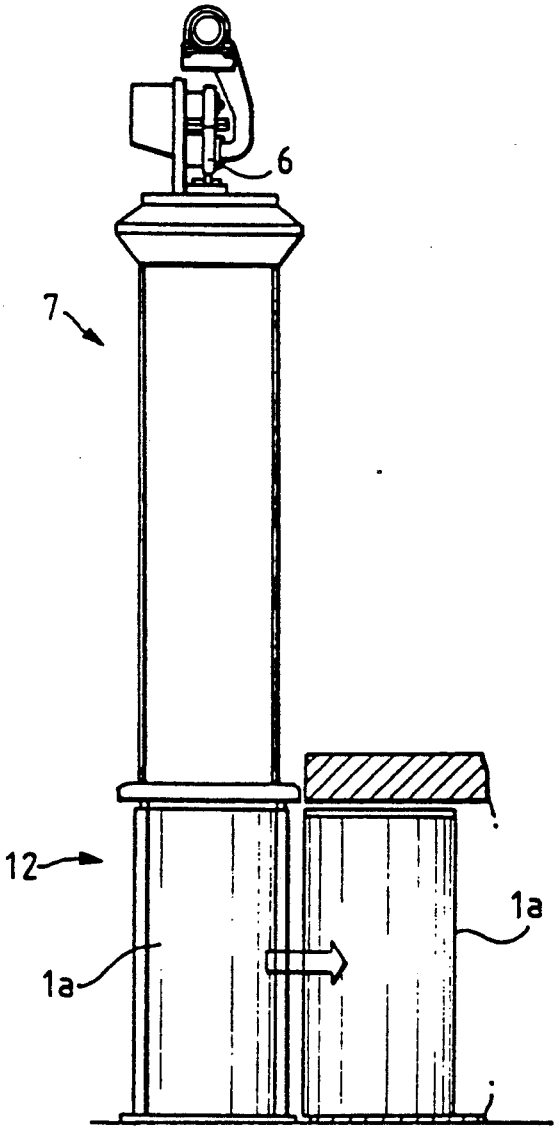
FIG. 16 is a view showing the delivery of a can from a carriage.

When a preliminary full-can signal has been outputted from the combing station, the carriage 7 travels to the comber 2a which has outputted the signal, as shown in FIG. 15, and the full-can cage 11 is lowered. If a full-can signal is outputted, two full cans 1b are forced out of the comber 2a into the full-can cage 11. The cage 11 which has received the full cans 1b is raised, as shown at the left end of FIG. 15, and after the position of the carriage 7 has been altered, the empty-can cage 12 is lowered, as shown in FIG. 16, and the two empty cans la are pushed out of the cage 12. Then, the cage 12 is raised.

Thus, the exchange of the cans for the comber 2a is completed, and the carriage 7 containing the full cans 1b travels along the track 92 in the direction of an arrow 90 to any drawing frame 3a that has indicated a demand for full cans. When the carriage 7 has arrived at the drawing frame 3a, the cage 11 containing the full cans 1b is lowered to the position where the full cans are to be lowered (as shown by circles containing slanting lines), and the full cans 1b are pushed out onto the delivery conveyor 3b (FIG. 12).

Then, the cage 11 is raised, and the carriage 7 returns to the point of origin $P_0$ on the empty-can conveyor 5. The empty-can cage 12 is lowered at the point of origin $P_0$, receives empty cans 1a from the conveyor 5, and is raised. The carriage 7 waits for another preliminary full-can signal from any comber 2a.

(d) Conveyance of cans between the drawing and roving stations:

Each drawing frame 3a comprises two spindles, and the drawing station usually comprises about 10 drawing frames 3a. According to the embodiment under description, four frames constitute one group. On the other hand, each roving frame 83 comprises 120 spindles, and the roving station usually comprises about 15 roving frames 83. According to the embodiment under description, five frames constitute one group.

Referring again to FIG. 14, the carriage 7 traveling along the track 93 between the drawing and roving stations has only a full-can cage 11. The carriage 7 is so constructed as to start traveling at a point of origin $R_0$ where full cans are to be lowered for delivery to the stock room 84, and reciprocate between the point of origin $R_0$ and the site in front of each drawing frame 3a where full cans are to be picked up (as shown by circles containing slanting lines).

The carriage 7 travels to any drawing frame 3a that has produced two full cans 1b, and the full-can cage 11 is lowered to receive the two full cans 1b. Then, the cage 11 is raised, and moved overhead to the site where the full cans are to be lowered (point of origin $R_0$) in front of the stock room 84 in the roving station. The cage 11 is lowered, and the two full cans 1b are pushed out of the cage 11 for delivery into the stock room 84.

The carriage is, then, moved to another drawing frame 3a that has produced two full cans 1b, receives them from it, and delivers them to a can conveyor 106 for the stock room 84 in the roving station. This sequence of operation is repeated to form a stock of full cans 1b in the stock room 84. In the stock room 84, the full cans 1b are successively transferred from the can conveyor 106 to a standby conveyor 107, until the standby conveyor 107 carries a total of 120 full cans 1b consisting of four rows of 30 cans each.

(e) Conveyance of cans between the stock room and the roving frames:

Each roving frame comprises 120 spindles, as already mentioned. When the 120 cans in any roving frame 83 become empty, it is necessary to exchange them with full cans. While it takes two or three days before the cans in the roving frame 83 become empty, it is necessary from a productivity standpoint to finish any such exchange promptly when the cans have become empty. It is, however, possible that all of the 120 cans may not be changed at a time, since it is usual practice to change either four or two rows of cans at a time in a roving frame. Each roving frame doffs about 15 bobbins of roving per can.

The track 94 along which the cans are conveyed in the roving station does not only form a closed loop extending around the five roving frames 83 and the stock room 84 which define one unit of machines for the roving station, but can also be connected to the track 94 for another unit by the switch tables 95 and connecting rails 110.

Figure 17A:
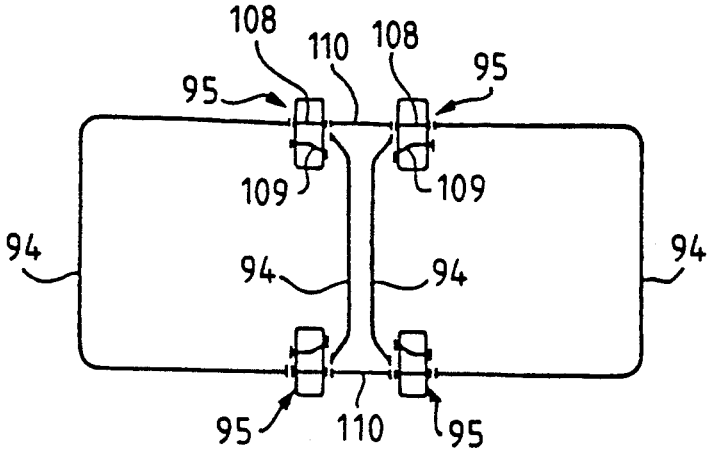
FIG. 17*a–c* is a set of views showing the construction and operation of switch tables.
Figure 17B:
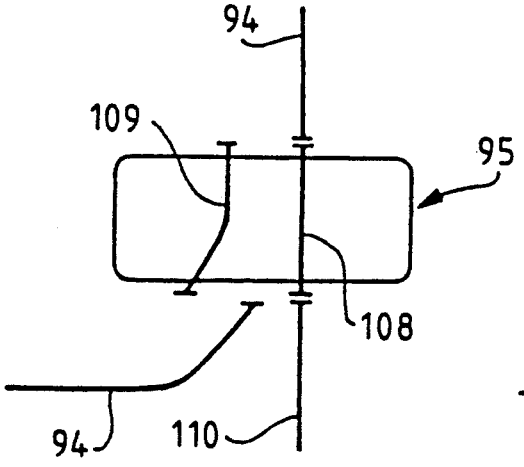
Figure 17C:
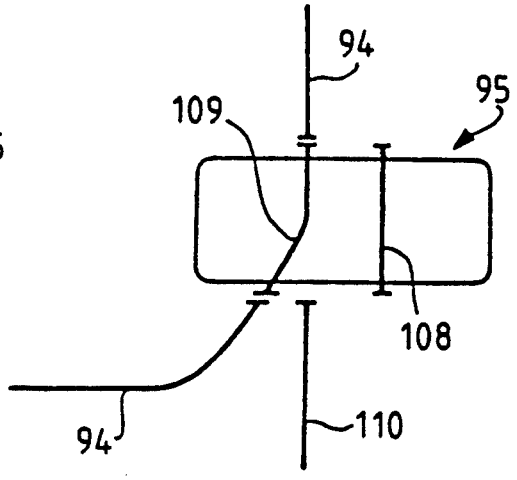
Figure 18A:
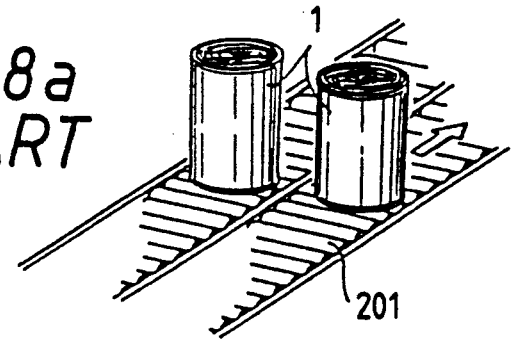
FIG. 18a PRIOR ART
FIGS. 18*a–c* and 19 are views showing the conventional can conveying systems.
Figure 18B:
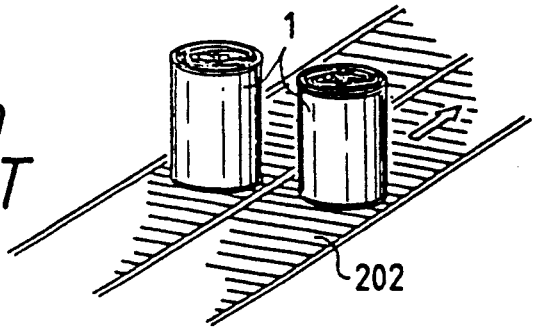
FIG. 18b PRIOR ART
Figure 18C:
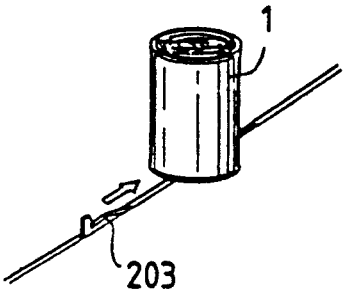
FIG. 18c PRIOR ART
Figure 19:
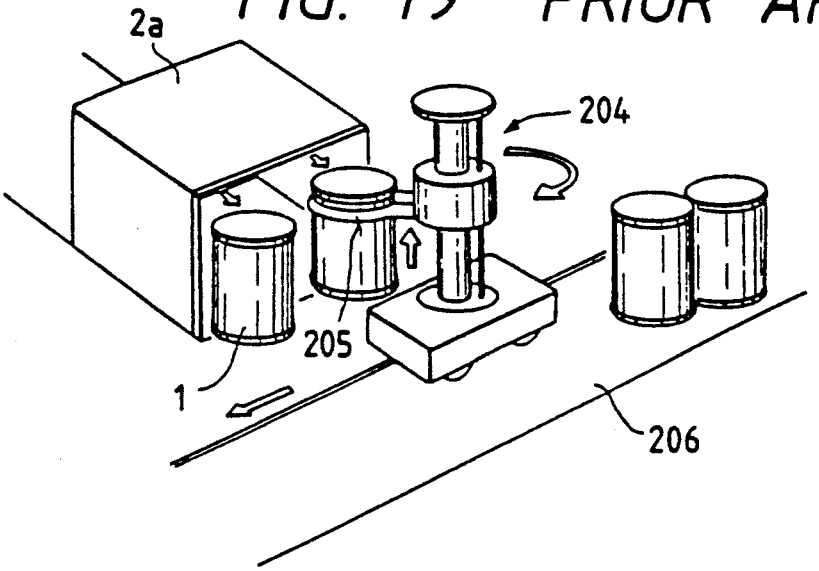
FIG. 19 PRIOR ART

Each switch table 95 has a straight rail 108 and a curved rail 109 as shown in FIG. 18a, and is movable so that either of the straight and curved rails 108 and 109 may be positioned between the track 94 and the connecting rail 110. If it is necessary to connect the tracks 94 for two adjoining units to enable the carriage 7 to travel straight from one unit to the other, the straight rail 108 is positioned between each track 94 and the connecting rail 110, as shown in FIG. 17b. If it is necessary to disconnect the tracks 94 to cause the carriage to travel along the track 94 for one unit alone, the curved rail 109 is positioned between the straight portion of the track 94 and the curved portion thereof, as shown in FIG. 17c.

According to the embodiment under description, the closed loop formed by the track 94 for one unit includes the empty-can conveyor 5. Each carriage 7 has only one cage that is used for holding full or empty cans. The carriages 7 are independent of one another, and are not connected in pair.

It is now supposed that all of the 120 cans have become empty in one of the roving frames 83 in Group A as shown in the right half of FIG. 14, e.g. #1. All of the switch tables 95 are, then, moved to connect the tracks 94 between every two adjoining units of the roving station to form a single closed loop connecting all of the tracks 94 in the roving station. The carriage 7 which has been staying along the track 94 in each unit travels to Group A, and all of the carriages 7 in the roving station gather in Group A. Then, all of the switch tables 95 are moved back to their original positions, and the track 94 in Group A restores its independence of the other tracks.

While the operation as hereinabove described is under way, the carriage 7 staying closest to the roving frame starts exchanging empty can with full cans.

More specifically, if a doffing signal is outputted from roving frame #1, the carriage 7 is moved to the position $R_1$ where it receives two full cans 1*b* from the standby conveyor 107 in the stock room 84, and is thereafter moved to the position $R_4$ where it lowers the full cans for delivery to roving frame #1, while the cans which have been emptied in roving frame #1 are carried to the position $R_2$ by a conveyor, or like device. The carriage 7 picks up two empty cans, lifts them, travels to the position $R_3$ where the empty cans are to be lowered, and lowers the empty cans 1*a* for delivery onto the empty-can conveyor 5. The empty cans 1*a* are conveyed by the conveyor 5 to the point $P_0$ below the track 92 between the combing and drawing stations.

Thus, all of the carriages 7 are used to receive empty cans 1*a* from roving frame #1 and deliver full cans 1*b* to it, thereby effecting a quick exchange of the 120 empty cans 1*a* with full cans 1*b*. Roving frame #1 which has received 120 full cans 1*b* is placed in operation again. The switch tables 95 are moved to enable each carriage 7 other than that for Group A to return to the track 94 for the group to which it belongs. Each roving frame doffs about 15 bobbins of roving per can.

This invention provides the outstanding advantages as will hereinafter be summarized.

As the suspended cages of the carriages convey sliver cans in the factory, the system of this invention enables the overhead conveyance of cans which has hitherto not been achieved. The system does not require any exclusive floor space for the installation of the necessary equipment, as opposed to the can conveying system installed on the ground, and does, therefore, not add to the floor area of the spinning factory as a whole. The system can convey cans along the shortest route by avoiding any horizontal or vertical interference. The path along which cans are conveyed can be made in parallel to the passage provided for general use between machines or stations, and the system does not form any obstacle to the operator who walks along the passage. Moreover, the system can convey cans without causing any compression of slivers by compression that may result in the lack of uniformity in sliver thickness.

Moreover, the system enables the automatic and unattended conveyance of sliver cans which has hitherto not been achieved. Therefore, it enables automatic connection between every two adjoining stations in a spinning factory, and provides a basis for the automation of the whole process which is carried out in the factory.

Further embodiment of the invention will be described.

It is proposed a can conveying system comprising a first station provided at an end of each drawing frame for delivering vacant cans and receiving full cans, a second station for delivering full cans, a third station for receiving vacant cans, an overhead traveling carriage having a vertically movably suspended can holding cage, and an overhead rail along which the carriage is capable of traveling from one station to another.

The overhead traveling carriage lowers its cage at one station to receive cans, raises it, travels to another station, and lowers its cage again to have the cans pushed out, whereby the cans are automatically conveyed from one station to another.

The embodiment of the invention will now be described with reference to the drawings.

Reference is first made to FIGS. 20 to 24 showing a system for supplying empty cans to, and collecting full cans from, a group of drawing frames installed in a first story.

Figures 20, 21:
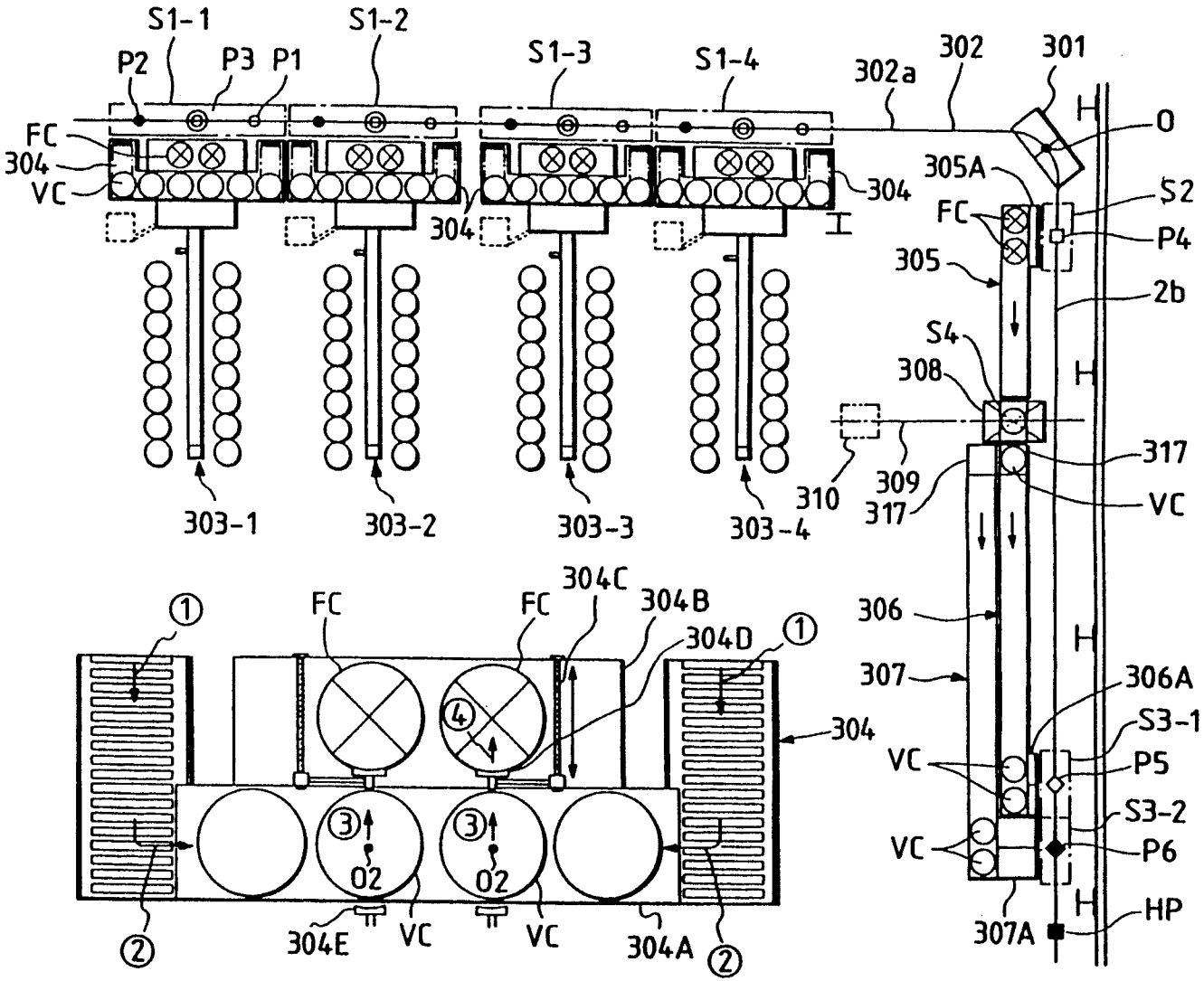
FIG. 20 is a view showing the still another route for the movement of the overhead traveling carriage in the first story and the layout of its stations.
FIG. 21 is a top plan view of the platform of a drawing frame.

FIG. 20 is a view showing the route for the movement of an overhead traveling carriage in the first story and the layout of its stations. FIG. 20 shows a first overhead traveling carriage 301 which is capable of reciprocating along an L-shaped overhead rail 302, four first stations S1-1, S1-2, S1-3 and S1-4 situated in a straight portion 302*a* of the rail, and a second station S2, two third stations S3-1 and S3-2, and a home position HP which are all situated in the other straight portion 302*b* of the rail. The first stations S1-1 to S1-4 are connected to the platforms 304 of drawing frames 303-1 to 303-4, respectively. The second station S2 is connected to the platform 5A of a full-can storage conveyor 305. The third stations S3-1 and S3-2 are connected to the platforms 306A and 307A of vacant-can storage conveyors 306 and 307, respectively. An exchange station S4 is situated between the full-can storage conveyor 305 and a switching device 317, and is connected to a second overhead traveling carriage 310 capable of reciprocating along an overhead rail 309 in the second story through an opening 308 made through the floor of the second story.

Description will now be made of the construction and operation of the platforms 304 of the drawing frames 303-1 to 303-4 with reference to FIG. 21. Each platform 304 comprises a can conveyor 304A and a full-can delivery table 304B. The can conveyor 304A receives two vacant cans VC on either side as shown by an arrow ① and conveys them in the direction of an arrow ② so as to keep in stock a total of four vacant cans VC on both sides of the vacant cans VC in the 02 positions. The vacant VC in the 02 positions receive slivers from the drawing frame and the resulting full cans FC are pushed out in the directions of arrows ③ by pusher plates 304E, whereafter vacant cans VC are set to receive slivers again. The two full cans FC which have been transferred onto the delivery table 304B are delivered to a cage, not shown, as will hereunder be described. The delivery table 304B is provided with pusher angles 304D which are capable of reciprocating along screw shafts 304C, respectively, when the shafts 304C are rotated. If the pusher angles 304D are advanced in the direction of an arrow ④, the full cans FC are delivered to the cage, and the pusher angles 304D are thereafter moved from their horizontal positions to their upright positions, and retracted to their original positions.

Figure 23:
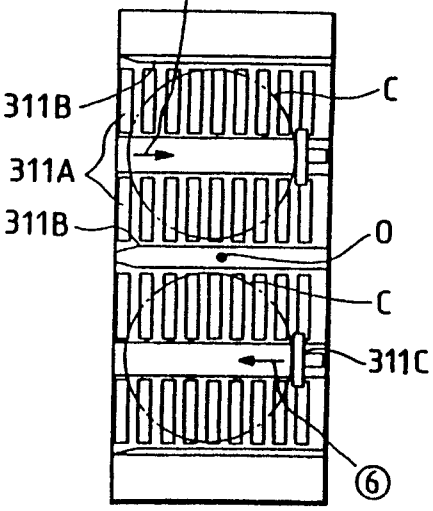
FIG. 23 is a view taken along the arrow A in FIG. 22.
Figure 22:
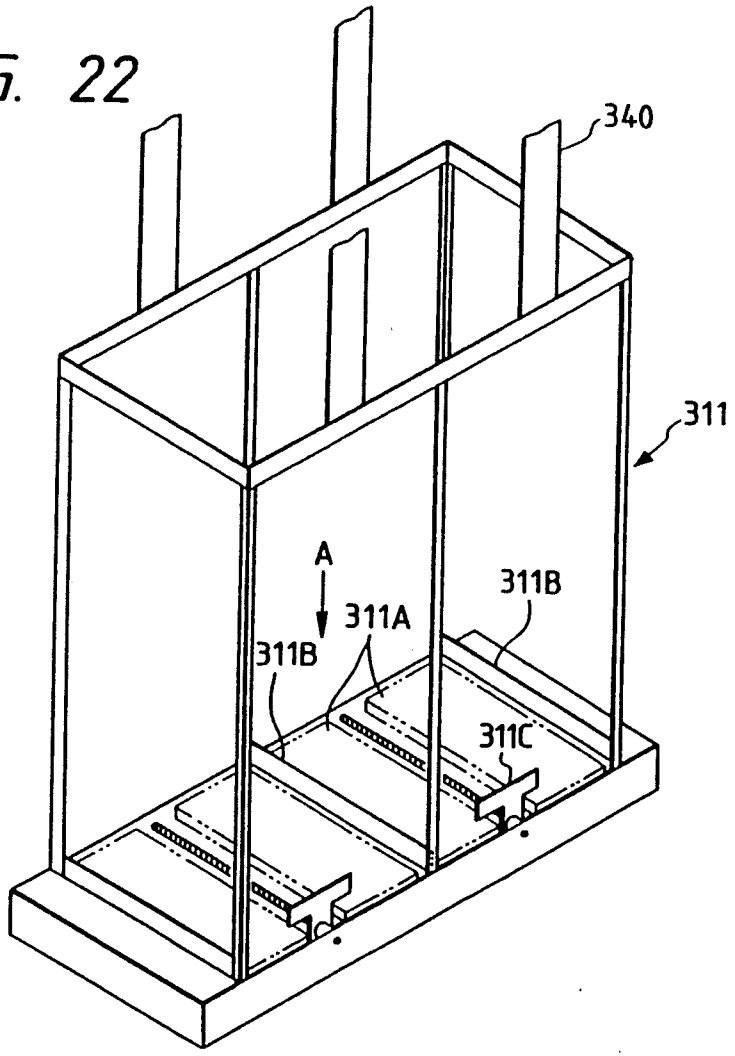
FIG. 22 is a perspective view of another embodiment of the cage suspended from the overhead traveling carriage.
Figure 24A:
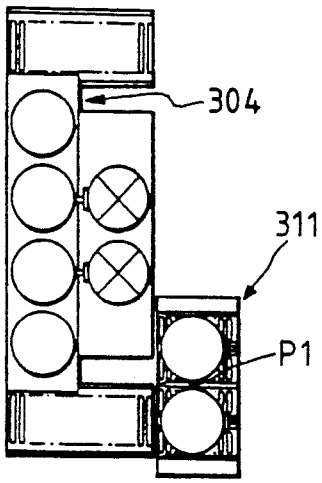
FIGS. 24*a–f* is a set of views showing the operation of the cage at the stop positions $P_1$, $P_2$ and $P_3$ in one of the first stations.
Figure 24B:
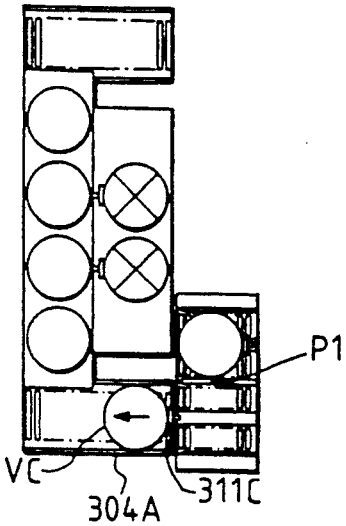
Figure 24C:
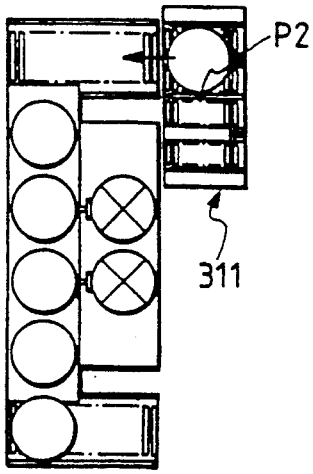
Figure 24D:
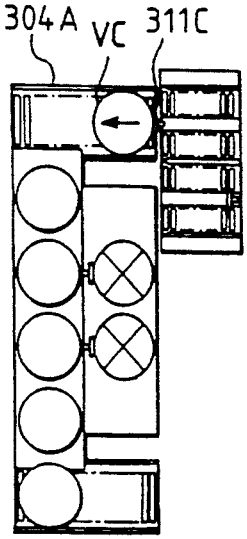
Figure 24E:
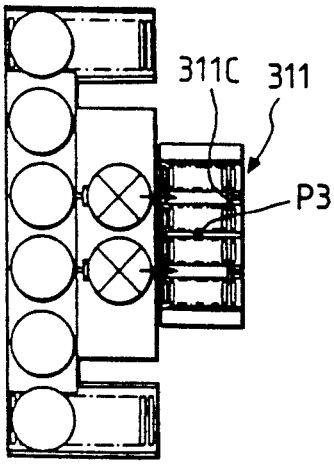
Figure 24F:
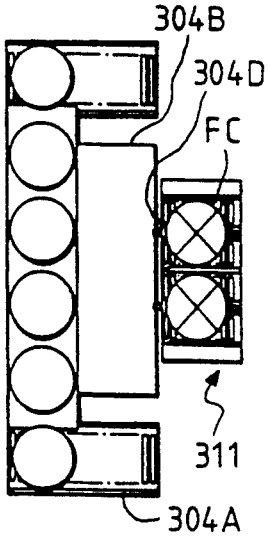

Attention is now directed to FIGS. 22 and 23 showing the cage which is moved from one station to another for delivering and receiving cans. The cage 311 is a twin rectangular framework and is supported by four belts 340 suspended from the overhead traveling carriage which will hereinafter be described in further detail. The cage can hold two cans C on both sides, respectively, of its center 0, as shown in FIG. 23. Rows of free rollers 311A and side guides 311B receive the can C as it is moved in the direction of an arrow (5), and position it as shown by a two-dot chain line. Each pusher plate 311C is capable of reciprocating along a screw shaft not shown, and pushing the can C in the direction of an arrow (6) to have it delivered out of the cage. Referring again to FIG. 20, the cage has three stop positions $P_1$ (marked by a white circle), $P_2$ (marked by a black circle) and $P_3$ (marked by a double circle) at each of the first stations S1-1 to S1-4, and is so stopped that its center O may fall on one of the three points. The cage has a single stop position $P_4$ (marked by a square) at the second station S2, and a single stop position $P_5$ (marked by a white diamond) or $P_6$ (marked by a black diamond) at each of the third stations S3-1 and S3-2.

Attention is now drawn to FIG. 24 showing the performance of the cage 311 at each of its stop positions $P_1$ to $P_3$ in each of the first stations. The cage 311 is lowered to the same level of height with the platform 304, as shown in FIG. 24*a*. One of the pusher plates 311C is advanced to push out a vacant can VC and deliver it onto the can conveyor 304A on one side of the platform, as shown in FIG. 24*b*. Then, the overhead traveling carriage travels to move the cage 311 to the stop position $P_2$, as shown in FIG. 24C. The other pusher plate 311C is advanced to push out another vacant can VC and deliver it onto the can conveyor 304A on the other side of the platform, as shown in FIG. 24*d*. Then, the carriage travels again to move the cage 311 to the stop position $P_3$, as shown in FIG. 24*e*, after the pusher plate 311C has been retracted. The pusher angles 304D on the delivery table 304B are advanced to deliver two full cans FC together into the cage 311, as shown in FIG. 24*f*. Referring once again to FIG. 20, description will be made of the performance of the cage at each of the stop positions $P_4$, $P_5$ and $P_6$ in the second and third stations. The cage which has received the two full cans at any first station is raised to its uppermost position, moved to the stop position $P_4$, and lowered to the same level of height with the platform 305A. The pusher plates 311C shown in FIG. 23 are advanced to push out the two full cans FC and deliver them onto the conveyor 305. Thus, a multiplicity of full cans FC are stored on the conveyor 305. The cage which is now empty at the stop position $P_4$ is raised to its uppermost position, and moved to the home position HP, where it waits for another chance to work. If a can exchange signal has been outputted from any of the drawing frames 303-1 to 303-4, the empty cage is moved to its stop position $P_5$ or $P_6$, and lowered to the same level of height with the platform 306A or 307A. The cage receives two vacant cans VC together from the conveyor 306 or 307. The two conveyors 306 and 307 are employed for the reason which will now be set forth. The drawing frames 303-1 to 303-4 do not necessarily produce the same kind of slivers, but may, for example, produce two kinds of slivers. The discrimination of the different kinds is effected by means for identification, such as a bar code or colored tape attached to each can, or a colored rubber band wound on each can. When a can exchange signal has been outputted from any of the drawing frames 303-1 to 303-4, it is necessary to supply the vacant can which is used for holding that kind of sliver which is produced by the drawing frame which has outputted the signal. The two conveyors 306 and 307 are, therefore, provided for supplying cans for two kinds of slivers, respectively. The means for identification which each full can carries makes it possible to determine automatically or manually the storage conveyor, or roving frame to which the can need be conveyed.

Although the cage 311 has been described as having the pusher plates 311C as shown in FIG. 22, it is alternatively possible to provide each station with pushers for pushing cans out of the cage 311.

Figure 29:
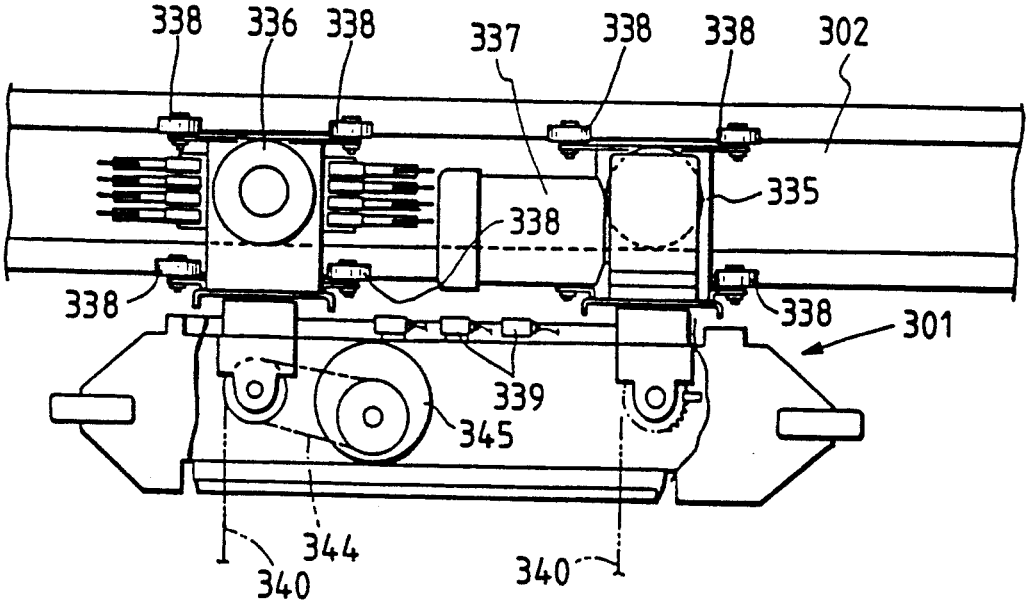
FIG. 29 is a side elevational view of the overhead traveling carriage.
Figure 30:
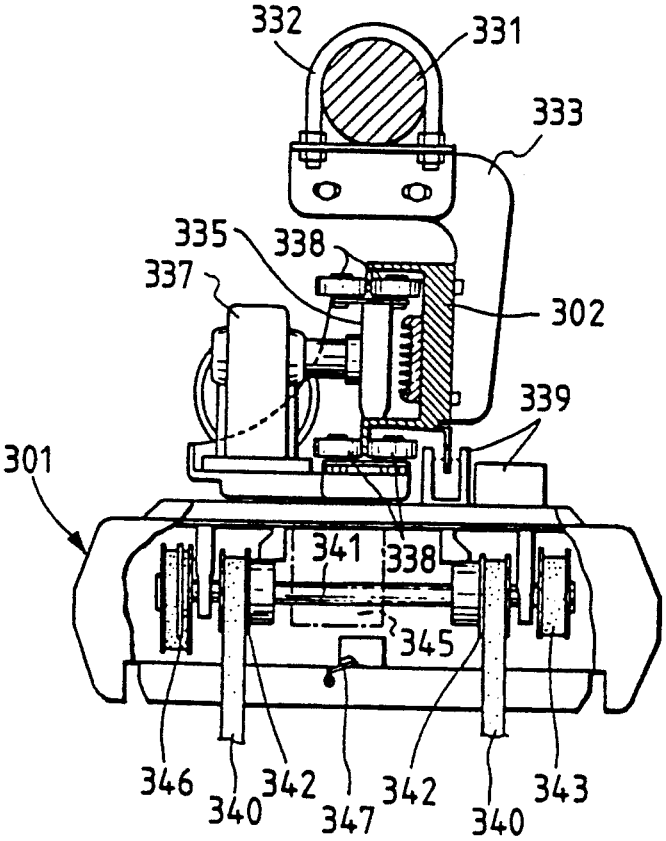
FIG. 30 is a front elevational view thereof.

Reference is now made to FIGS. 29 and 30 showing by way of example the construction and operation of the overhead traveling carriage from which the cage is vertically movably suspended. As shown in FIGS. 29 and 30, the overhead traveling carriage 301 includes a driving wheel 335 capable of moving along the rail 302 supported by hangers 333 attached to e.g. a ceiling beam 331 by U-bolts 332, a driven wheel 336, and a motor 337 for driving the driving wheel 335. The overhead traveling carriage 301 is provided at its top with a plurality of guide rollers 338 engaging the rail 302 at a plurality of points for preventing the carriage 301 from swaying on the rail 302. The overhead traveling carriage 301 is also provided with a plurality of appropriately positioned sensors 339 which can detect, for example, the stopping and passing of the carriage. Description will now be made of the mechanism by which the cage is vertically movably suspended from the overhead traveling carriage 301. The overhead traveling carriage 301 has a pair of horizontal shafts 341 for winding and unwinding the belts 340 from which the cage is suspended. Each horizontal shaft 341 is provided at each end thereof with a drum 342 about which one of the belts 340 is wound. The horizontal shafts 341 are connected to each other by a timing belt 343 so as to be rotatable together. A raising and lowering motor 345 is connected by a belt 344 to one of the horizontal shafts 341 to rotate it to thereby effect the winding or unwinding of the belts 340. The other horizontal shaft 341 is provided at one end thereof with an encoder 346 for measuring the length by which the belts 340 have been wound or unwound. A limit switch 347 is appropriately located for detecting the cage in its uppermost position.

Figure 25:
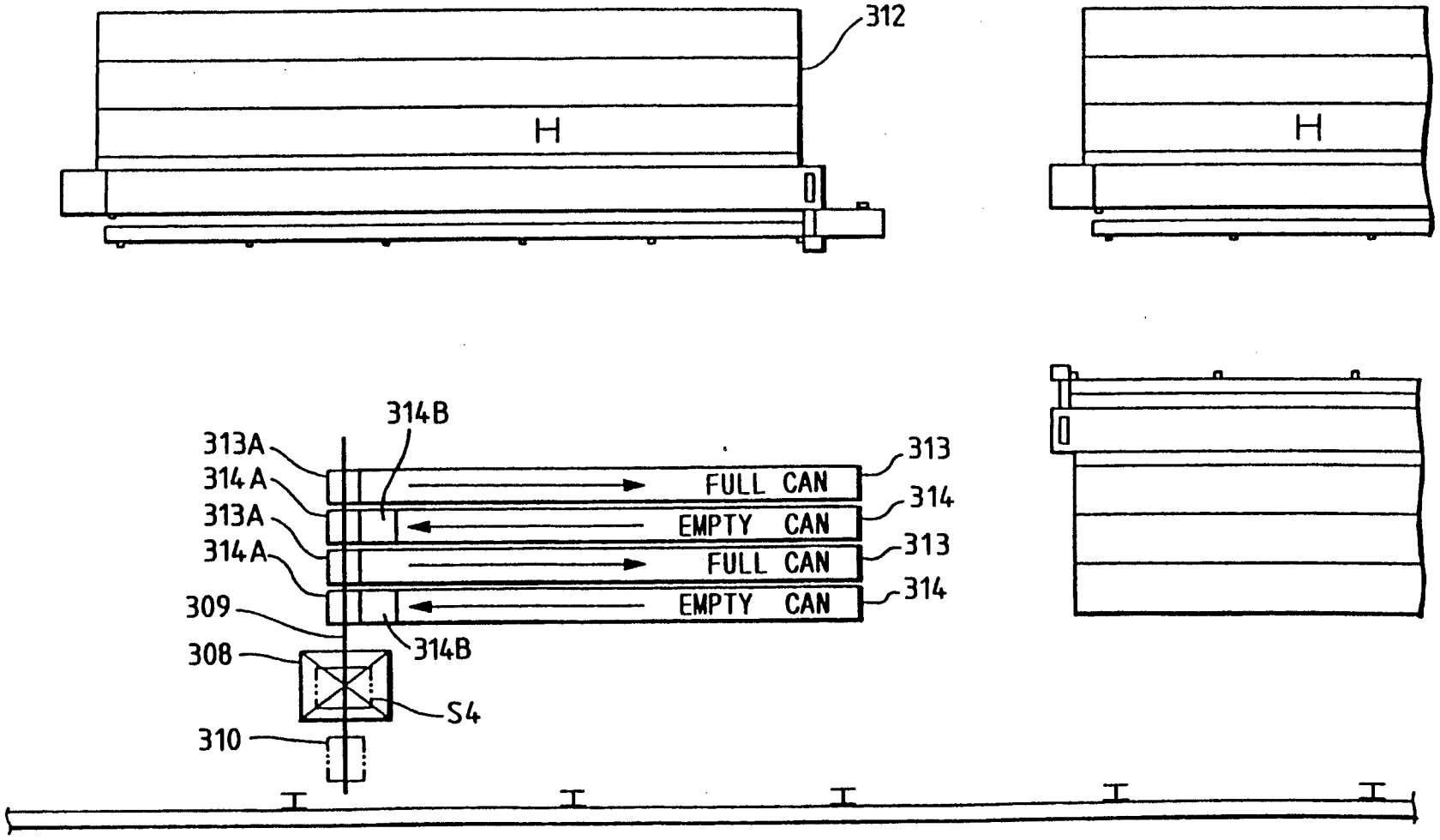
FIG. 25 is a view showing the layout of equipment in the second story where the roving frames are installed.
Figure 26:
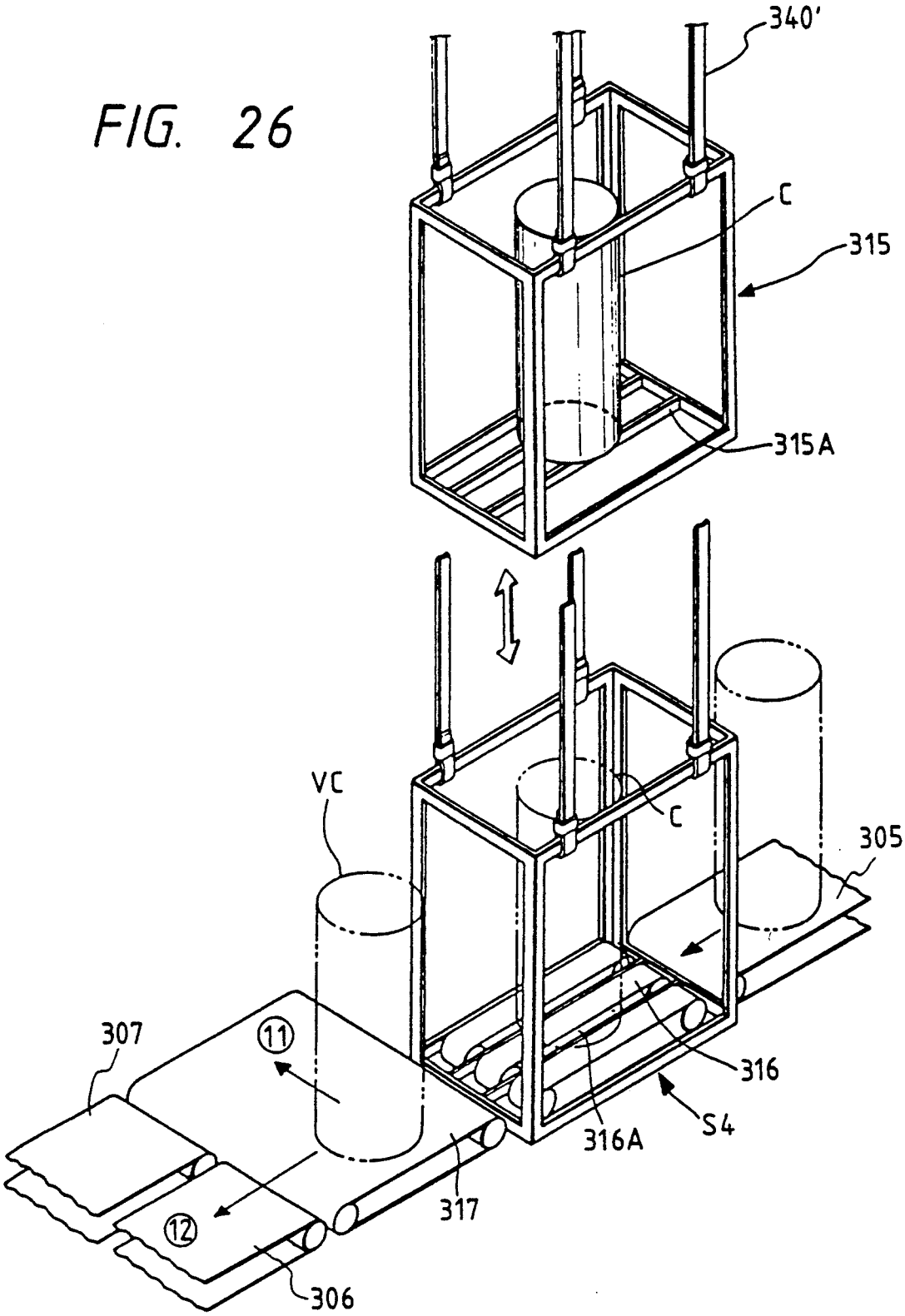
FIG. 26 is a perspective view of still another embodiment of the cage of the overhead traveling carriage and the exchange station.
Figure 27A:
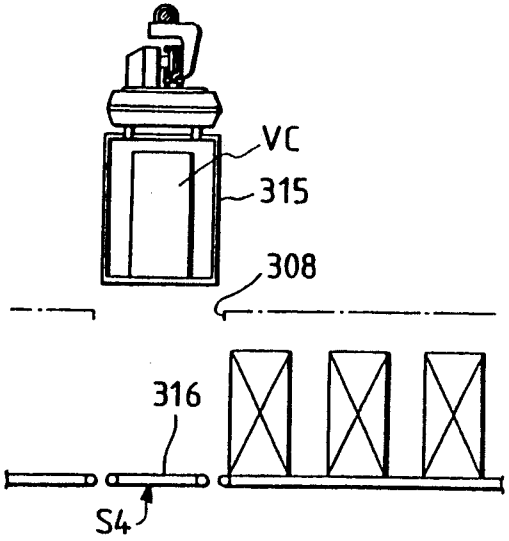
FIG. 27*a–d* is a set of views showing the operation of the cage and the parallel conveyors.
Figure 27B:
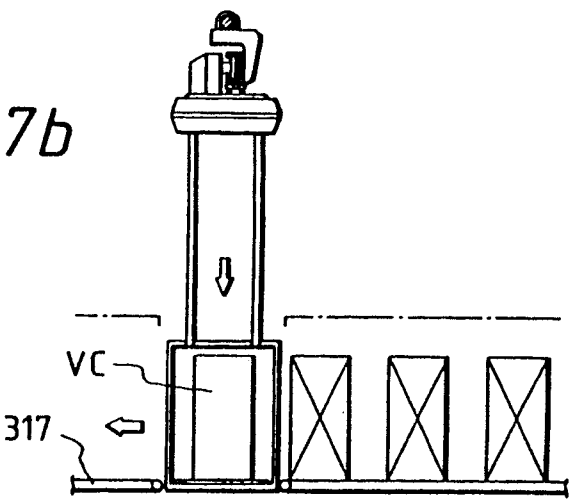
Figure 27C:
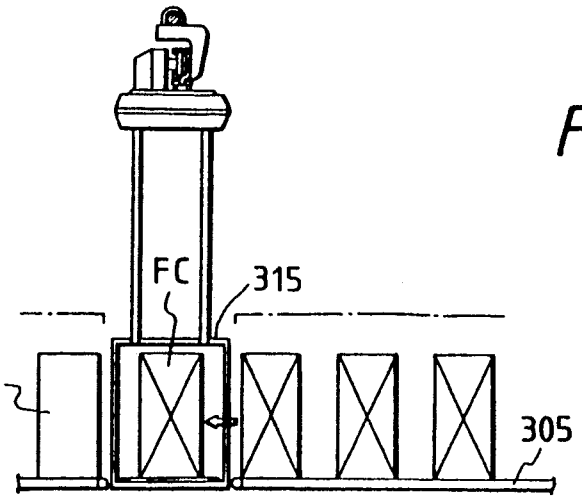
Figure 27D:
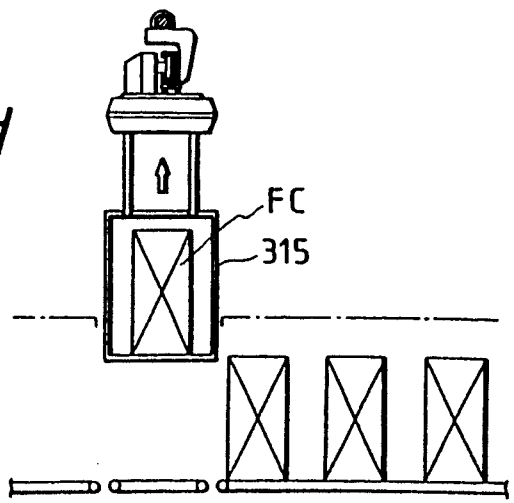

The foregoing description has been of the system for conveying cans to and from the drawing frames installed in the first story. Description will now be made of the conveyance of cans to the roving frames installed in the second story. FIG. 25 shows the layout of equipment in the second story in which the roving frames are installed. Two full-can storage conveyors 313 and two empty- or vacant-can storage conveyors 314 are alternately installed for common service to a multiplicity of roving frames 312. The overhead rail 309 in the second story along which the second overhead traveling carriage 310 is capable of traveling extends immediately above the unloading portions 313A of the full-can storage conveyors 313 and the loading portions 314A of the empty-can storage conveyors 314, and the cage of the second overhead traveling carriage 310 can be lowered to the exchange station S4 through the opening 308 in the floor of the second story. Referring now to FIG. 26, description is made of the construction of the cage of the second overhead traveling carriage and the exchange station. The cage 315 is a rectangular framework and has at its bottom a plurality of bars 315A defining its floor on which a can C can be mounted. The exchange station S4 comprises a plurality of parallel conveyors 316, and when the cage 315 is lowered, each bar 315A sinks in the gap 316A between one pair of adjoining conveyors 316, whereby the can C is transferred onto the conveyors 316. When the cage 315 is raised, the can C on the conveyors 316 is transferred into the cage 315 as the bars 315A are raised above the conveyors 316. The parallel conveyors 316 are connected to the switching device 317 for the full-can storage conveyor 305 and the vacant-can storage conveyors 306 and 307. The switching device 317 distinguishes any vacant can VC by the means for identification which it carries, and delivers it to either of the vacant-can storage conveyors 306 and 307. The operation of the cage 315 and the parallel conveyors 316 will now be described with reference to FIG. 27. Referring first to FIG. 27*a*, the cage 315 containing a vacant can VC is lowered on the parallel conveyors 316 of the exchange station S4 through the opening 308. Then, the vacant can VC is delivered onto the switching device 317, as shown in FIG. 27*b*. At the same time, a full can FC is supplied from the conveyor 305 into the cage 315, as shown in FIG. 27C. Then, the cage 315 containing the full can FC is raised to the second story through the opening 308, as shown in FIG. 27*d*. Referring again to FIG. 25, the cage is moved to deliver the full can FC to the unloading portion 313A of either of the full-can storage conveyors 313 depending on the kind of the sliver which can be distinguished by the means for identification which the can FC carries. Then, the cage receives a vacant can VC from the loading portion 314A of either of the adjoining conveyors 314, and returns to its position as shown in FIG. 27*a*. The foregoing sequence of operation is repeated to deliver full cans FC and collect vacant cans VC to and from the conveyors 313 and 314, respectively, as classified by the kind of sliver. Each can is conveyed by a truck from one of the conveyors 313 and 314 to one of the roving frames.

Figure 28:
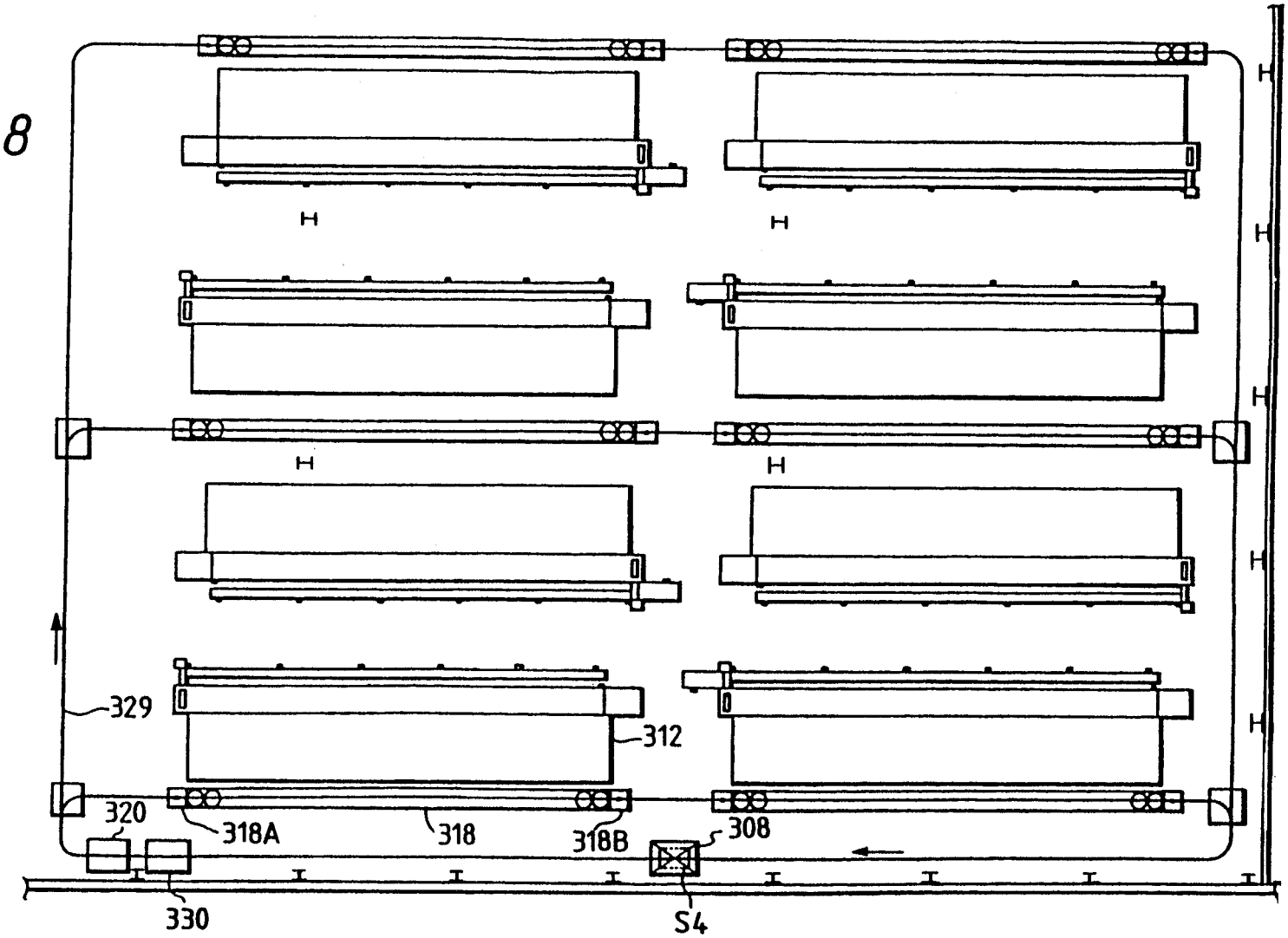
FIG. 28 is a view showing by way of example another layout including roving frames.

FIG. 28 shows by way of example another layout including roving frames. This layout includes a full- and vacant-can storage conveyor 318 installed along each roving frame 312 for feeding can pitch by pitch, as opposed to the layout of FIG. 25 including the common conveyors for all the roving frames. The conveyor 318 has an unloading portion 318A and a loading portion 318B at both ends, respectively. An overhead rail 329 forming a closed loop lies above the unloading and loading portions 318A and 318B, and two overhead traveling carriages 320 and 330 are capable of traveling along the rail 329. The full can which has been conveyed from the exchange station S4 through the opening 308 is lowered on the unloading portion 318A, and a vacant can is received from the loading portion 318B of the same conveyor, and conveyed to the exchange station S4 through the opening 308. The overhead rail 329 in loop form and the two overhead traveling carriages 320 and 330 enable the efficient conveyance of cans. Incidentally, it is possible to construct the overhead rail 302 of FIG. 20 in loop form and employ two overhead traveling carriages in the system of FIG. 20, too.

Referring again to FIGS. 20 and 25, description will now be made of the conveying system which connects the drawing and roving frames.

Referring first to FIG. 20, the overhead traveling carriage travels from the home position HP to the third station S3-1 or S3-2, depending on the vacant cans VC to be received, as classified by the kind of sliver, from any drawing frame that has outputted a can exchange signal, stops at the stop position $P_5$ or $P_6$, and lowers the cage. It receives two vacant cans VC, raises the cage, and travels to the platform 304 of the drawing frame which has outputted the can exchange signal. It stops at the stop position $P_1$ in the first station, lowers the cage, and delivers one of the vacant cans. Then, it raises the cage to some extent, moves to the stop position $P_2$, lowers the cage, and delivers the other vacant can VC. Then, it raises the cage to some extent, moves to the stop position $P_3$, lowers the cage, receives two full cans FC, raises the cage, and travels to the second station S2. It stops at the stop position $P_4$, lowers the cage, and delivers the two full cans FC onto the platform 305A, whereby a multiplicity of full cans FC are eventually stored on the conveyor 305.

The cage of the overhead traveling carriage 310 in the second story holds a vacant can and is lowered to the exchange station S4. It transfers the vacant can VC to the switching device 317, and receives a full can. The vacant can VC is transferred from the switching device 317 for storage on the conveyor 306 or 307, depending on the kind of sliver which it is to hold. Referring to FIG. 25, the full can is delivered onto the unloading portion 313A of either of the conveyors 313, depending on the kind of sliver which it contains. Then, the cage is moved to the loading portion 314A of either of the adjoining conveyors, receives a vacant can, and is lowered to the exchange station S4 through the opening 308. As is obvious from the foregoing description, the conveyance of cans between the drawing and roving frames can be effected automatically without the aid of any truck or elevator.

The can conveying system of this embodiment of the invention comprises a first station provided at an end of each drawing frame for delivering vacant cans and receiving full cans, a second station for delivering full cans, a third station for receiving vacant cans, an overhead traveling carriage having a vertically movably suspended can holding cage, and an overhead rail along which the carriage is capable of traveling from one station to another. The overhead traveling carriage lowers the cage at one station to receive cans, raises it, travels to another station, and lowers the cage to have the cans pushed out. The system does not require any floor space for the overhead traveling carriage, but can easily collect cans at one position and deliver them at another, even if the cans may be large.

What is claimed is:

1. In a system including a drawing frame defining an end, a can conveying system comprising:

a first station provided adjacent the end of the drawing frame for delivering empty cans and for receiving full cans, a second station for delivering full cans, a third station for receiving empty cans, a fourth station for exchanging cans, a first overhead traveling carriage having a suspended, vertically movable can holding cage, a first overhead rail positioned at a first substantially horizontal level along which the first carriage travels to the first station, the second station and the third station, a full can storage conveyor located substantially between the second station and the fourth station, a empty can storage conveyor located substantially between the third station and the fourth station, a switching device provided at an end of the empty can storage conveyor adjacent the fourth station, a second overhead travelling carriage, a second overhead rail positioned at a second substantially horizontal level above the first substantially horizontal level along which the second carriage travels, wherein the exchange station and the second overhead travelling carriage are connected.

2. A can conveying system comprising:

an exchange station defining a first substantially horizontal level, the exchange station comprising a plurality of substantially parallel conveyors, each adjacent pair of the substantially parallel conveyors defining a cap therebetween, a plurality of storage conveyors defining a second substantially horizontal level, the second level being above the first level, the plurality of storage conveyors comprising at least one of a full can storage conveyor and an empty can storage conveyor, the plurality of storage conveyors defining a loading section and an unloading section, an overhead traveling carriage having a can holding cage, the cage comprising a plurality of substantially parallel bars defining a floor for supporting a can, and an overhead rail along which the carriage travels, the overhead rail extending above the unloading section and the loading section, the exchange station being positioned so that the cage of the overhead traveling carriage is lowerable to the exchange station, and the plurality of bars and the plurality of conveyors being mutually spaced so that when the cage is lowered to the exchange station, each of the plurality of bars is received by a corresponding one of the gaps between adjacent conveyors, thereby enabling transfer of a can from the cage to the conveyors.

* * * * *

UNITED STATES PATENT AND TRADEMARK OFFICE

CERTIFICATE OF CORRECTION

PATENT NO. : 5,257,897

DATED : November 2, 1993

INVENTOR(S) : Yoshio Yamamoto, et al.

It is certified that error appears in the above-identified patent and that said Letters Patent is hereby corrected as shown below:

On title page, item [73] after "Murata Kikai Kabushiki Kaisha" insert --and Kondo Cotton Spinning Co., Ltd.--.

Signed and Sealed this

Twenty-seventh Day of September, 1994

*Attest:*

*Attesting Officer*

BRUCE LEHMAN

*Commissioner of Patents and Trademarks*